US006202605B1

(12) United States Patent
Henriksen

(10) Patent No.: US 6,202,605 B1
(45) Date of Patent: Mar. 20, 2001

(54) ARRANGEMENT IN A TWO CYCLE COMBUSTION ENGINE WITH INTERNAL COMBUSTION

(76) Inventor: Leif Dag Henriksen, Lukseejeli, 266 N-3721 Skein (NO)

( * ) Notice: Subject to any disclaimer, the term of this patent is extended or adjusted under 35 U.S.C. 154(b) by 0 days.

(21) Appl. No.: 09/319,035

(22) PCT Filed: Apr. 22, 1998

(86) PCT No.: PCT/NO98/00125

§ 371 Date: Jul. 28, 1999

§ 102(e) Date: Jul. 28, 1999

(87) PCT Pub. No.: WO98/49437

PCT Pub. Date: Nov. 5, 1998

(30) Foreign Application Priority Data

Apr. 25, 1997 (NO) ..... 971907

(51) Int. Cl.[7] ..... F02B 75/26
(52) U.S. Cl. ..... 123/51 B
(58) Field of Search ..... 123/51 B, 51 BC, 123/51 BD

(56) References Cited

U.S. PATENT DOCUMENTS 4,526,141 * 7/1985 Catchpole ..... 123/51 BA
4,565,165 * 1/1986 Papanicolaou ..... 123/51 BA
4,635,590 * 1/1987 Gerace ..... 123/53.6
5,031,581 * 7/1991 Powell ..... 123/51 B
5,507,253 * 4/1996 Lowi, Jr. ..... 123/56.9

* cited by examiner

*Primary Examiner*—Willis R. Wolfe
*Assistant Examiner*—Hyder Ali
(74) *Attorney, Agent, or Firm*—Francis C. Hand; Carella, Byrne, Bain, Gilfillan, Cecchi & Olstein

(57) ABSTRACT

The internal combustion engine has a plurality of cylinders which are arranged in an annular series about a common central drive shaft. Each cylinder includes a pair of opposed pistons which are movable towards and away from each other while defining a combustion chamber therebetween. Each piston is connected to a piston rod which causes rotation of a cam guide device secured to the drive shaft. Each cam guide device has a curved cam surface having portions in phase-displaced relation to the curved cam surface of the other cam guide device as well as portions in mutually-phased relation. The cam surfaces each have a rectilinear portion to define a stationary combustion chamber for combustion between the pistons of each cylinder. The cam guide devices also have portions to permit opening of the exhaust ports prior to opening of the air scavaging ports of the cylinder.

13 Claims, 20 Drawing Sheets

ARRANGEMENT IN A TWO CYCLE COMBUSTION ENGINE WITH INTERNAL COMBUSTION

The present invention relates to an arrangement in a two cycle combustion engine with internal combustion, comprising a plurality of engine cylinders, which are arranged in an annular series around a common central drive shaft and which have cylinder axes running parallel to the drive shaft, each cylinder including a pair of pistons movable towards and away from each other and for each pair of pistons a common, intermediate work chamber, while each piston is equipped with its axially movable piston rod, the free outer end of which forms via a support roller a support against its curve-shaped, that is to say "sine"-like curve shaped, cam guide device, which is arranged at each of opposite ends of the cylinder and which guides movements of the piston relative to the associated cylinder.

Geometric Considerations of the Afore-mentioned Motor System

When the drive shaft of the engine is moved in a circular path, the oscillation movements of the engine pistons can correspondingly according to the afore-mentioned motor system be observed graphically as to time in a sine-shaped curve path according to Formula 1: y=sine x.

From DE 43 35 515 it is priorly known two stroke engines of the art described initially, having a single cylinder provided with two opposed pistons and having conventional crank shafts and conventional crank arms. Formel 1 is also relating to each crank shaft of such engine. In order to optimise the combustion in such engine it is suggested mutually displaced piston movement phases for the two opposed pistons of the cylinder.

By the use of a sine curve-shaped cam guide device and respectively by the use of conventional crank shafts the backwards and forwards piston movements of the individual pistons of the cylinders can in fact be controlled, so that the oscillation movements of the pistons synchronously coincide with the rotational movement of the drive shaft. Over the course of a complete rotation of the drive shaft, the pistons are moved backwards and forwards in a forcibly controlled manner in one or more working strokes, which are accurately synchronised with the rotational movement of the drive shaft. In other words the rotational movement of the cam guide device and the drive shaft will be directly connected to the oscillation movement of the pistons, and vice-versa.

The backwards and forwards movements of the pistons will correspondingly constitute a multiple of the rotary movement of the drive shaft with each 360° rotation of the drive shaft. In other words each piston will move backwards and forwards in the associated cylinder a total number of times, that is to say from one to for example four times with each 360° rotation of the drive shaft.

Owing to the cam guide device, which controls the oscillating movements of the pistons in an associated cylinder, being rotated synchronously with the drive shaft of the engine, the oscillation movements of the pistons can consequently be controlled by designing the cam guide device with a sine-shaped curve contour, so that these conform to the rotational movement of the drive shaft.

"Sine"-like Concept.

When the term "sine"-like is employed herein in connection with expressions, such as "sine"-like concept, "sine"-like curve, "sine"-like plane, etc.), a curve contour is expressed which does not constitute a mathematical sine contour according to the formula 1 above, but on the other hand expresses a varying curve contour, which only generally resembles the path of a mathematical sine contour. By the term "sine"-like contour there shall be designated generally herein a contour which is like but differs from a sine contour.

According to the invention the aim is, in certain constructional connections, with regard to designing the cam guide device with a particular curve contour which in different ways deviates from a mathematical sine contour.

Generally this means further, according to the invention, that by designing the cam guide device with a specially fashioned "sine"-like contour, which deviates from a conventionally known sine contour, the piston movements can be adapted in a corresponding manner to additional engine functions relative to the rotational movement of the drive shaft and relative to previously proposed solutions.

According to the invention the general aim is to design the cam guide device so that there is a possibility of achieving optimum operating conditions for pistons of the motor, based on a simple and operatively reliable operating sequence.

When one speaks herein about "sine"-like plane, there is meant the local part of the cam guide device, which has a "sine"-like curve contour. In practice the individual cam guide device has a 360° arcuate contour, which corresponds to a multiple of such said "sine"-like planes.

Combustion engines, where the axial movement of the pistons is individually controlled by a cam guide device via associated "sine"-like planes, function generally according to the so-called "sine"-like concept, which has been known for a number of years.

Originally the "sine"-like plane has had a contour, which resembles to a large degree the mathematical sine contour, that is to say with mutually symmetrical and uniformly curved curve portions.

According to the patent literature, curve contours have gradually been proposed which in different ways deviate from the mathematical sine contour. This is also typical of the curve-contour of the cam guide devices according to the present invention.

According to the "sine"-like concept the mechanical energy is transferred from the single piston to the common drive shaft of the engine cylinder, that is to say via a support roller of an associated piston rod to the "sine"-like plane of the cam guide device. The "sine"-like planes, which separately control the oscillation movements of the pistons, transfer during the oscillation movements of the pistons:

- partly kinetic energy from the expansion stroke of the pistons via the "sine"-like plane to the drive shaft, so as to subject the drive shaft to a rotary movement with associated torque, and
- partly torsional moments from the drive shaft via the "sine"-like plane back to the pistons, so as to subject the pistons to the necessary kinetic energy during the compression stroke.

In combustion engines of the kind indicated by way of introduction the pistons are moved axially backwards and forwards in associated cylinders, almost exclusively in rectilinear movements axially along the drive shaft, while the piston rods and associated support rollers are moved in corresponding rectilinear movements and consequently transfer motive forces from the support rollers to the associated "sine"-like plane in an axial direction along the drive shaft.

The transfer of the motive forces from the pistons via support rollers to the "sine"-like plane, which is designed in driving connection with the drive shaft, and return forces which are transferred in the opposite direction from the drive shaft to the pistons via the "sine"-like plane, occur on curve portions which extend obliquely of the rotational plane of the drive shaft. In other words motive forces are transferred between the support rollers and the "sine"-like plane during displacement of the support rollers axially along the drive shaft. In the dead points between the backwards and forwards going piston stroke there occurs however no transfer of motive forces, this despite that in the one dead point, that is to say at the close of the compression stroke and after ignition of injected fuel, significant motive forces arise between the pistons going towards and away from each other.

With the present invention the particular aim is to utilize the last-mentioned condition in connection with a special design of the cam guide device, so that in said dead point a hitherto disregarded possibility can be achieved for controlling the combustion process of the engine in an especially favorable manner.

Comparison of Four Stroke and Two Stroke Engines.

In a four stroke combustion engine the piston rods transfer their motive forces via the "sine"-like plane in the respective four strokes, that is to say with minimal forces in the air suction stroke, with substantially greater forces in the compression stroke, with the largest forces in the expansion stroke and with minimal forces in the exhaust ejection stroke.

In a two stroke-combustion engine the piston rods transfer their motive forces via the "sine"-like plane in the respective two strokes, that is to say with relatively small forces in a combined air injection and compression stroke and with substantially greater forces in a combined expansion and exhaust ejection stroke.

However it is also usual to allow air suction/air injection and exhaust ejection to occur more or less in parallel at the end of the combined expansion and exhaust ejection stroke and at the beginning of the combined air injection and compression stroke.

Four stroke engines have hitherto generally had a dominating use on the market, relative to the two stroke engine, within many different fields of application (by way of example for petrol engines for private cars). As a result of the operating strokes of the four stroke motor being distributed over four piston strokes, there is a greater prospect of adapting the individual functions of the single strokes in a simpler manner than in a two stroke engine, where all the current functions must be adapted over two strokes.

The functions of the two stroke engine are necessarily more compact and thereby also more complicated, than in four stroke engines. Four stroke engines have hitherto also been simpler to adapt with the "sine"-like concept than two stroke engines. On the other hand two stroke engines have various other advantages over four stroke engines, precisely as a consequence of a fewer number of operating strokes.

With the present invention the aim is inter alia to solve the problems one has hitherto had with two stroke engines in connection with the application of the "sine"-like concept. According to the invention the aim is to design the cam guide device in a particular manner, so that the "sine"-like concept can be utilized in two stroke engines under correspondingly favorable or under still better operating conditions than in four stroke engines.

Historic Development of the "sine"-like Concept:

A four stroke combustion engine is known from for example U.S. Pat. No. 1,352,985 (1918) having a single cam guide device. The cam guide device is based on a sole, common cam control for a sole, annular series of pistons in each of their associated separate engine cylinders. Each and all the cylinders are correspondingly arranged in a sole, annular series around the drive shaft of the engine. The piston rods are separately shored up via their respective support rolls in the common cam guide device.

From U.S. Pat. No. 1,802,902 (1929) for instance a four stroke combustion engine is known having a corresponding single cam guide device. In this case, instead of just one series of pistons, there are employed two series of pistons axially separated, but mutually directly coupled together. The pistons are arranged in tandem in their respective axially oppositely facing cylinders, that is to say the cylinders and the pistons are placed aligned in pairs, axially opposite each other. The pistons are furthermore rigidly connected to each other via a common piston rod and have their respective piston heads turned away from each other at axially opposite ends of the engine each towards its respective working chamber in its respective associated cylinder. The pistons cooperate in pairs with just one, common cam guide device. The common piston rod of each pair of pistons is provided in a middle region between the shirt portions of the pistons with a common support roller, which is supported and is controlled in a common, sole cam guide device for all the pistons. More specifically a centrally arranged cam guide device is employed with a double-sided arrangement of mutually opposite "sine"-like planes following in series, which cooperate with a single series of support rollers.

The aforementioned placing of the cam guide device and the support rollers centrally between two series of mutually opposite pistons, where there is employed a single series of support rollers in a common, double-sided cam guide device, gives little possibility of deviating contours in the two co-operating series of oppositely facing "sine"-like planes, since the contours of the "sine"-like planes are necessarily adapted after the opposite working phase of the respective two oppositely facing pistons of the pair of pistons.

From U.S. Pat. No. 5,031,581 (1989) for instance a four stroke combustion engine is known having two separate cam guide devices. In addition said patent is relating to a two stroke engine. Each cam guide device, which co-operates with its respective set of pistons and with its respective associated set of support rollers, is individually designed corresponding to the construction according to U.S. Pat. No. 1,352,985.

According to U.S. Pat. No. 5,031,581 the cylinders are arranged in a single group of cylinders, that is to say the cylinders are arranged in an annular single series around the drive shaft. The pistons, which are received in pairs in a respective one of the cylinders, are served by two separate cam guide devices, that is to say the one piston of each pair of pistons is controlled by a first cam guide device, while the remaining piston is controlled by a second cam guide device. Each cylinder is consequently equipped with separate pistons movable in pairs towards and away from each other each with its separate piston rod, which co-operates individually via an associated support roller with a respective one of two opposite cam guide devices with associated "sine"-like planes. The cam guide devices of the two axially distinct groups of pistons are arranged axially endwise outside respective ends of the engine. The piston heads of said pairs of pistons face mutually towards each other in a common working chamber of the associated cylinder, that is to say towards a common working chamber, which is arranged midway between said pair of pistons.

In GB 2 019 487 a four cylinder two stroke engine is shown with a pair of pistons going towards and away from each other in each of said four cylinders. An arrangement is employed where the ignition occurs simultaneously in two of the four cylinders, that is to say in pairs of alternate cylinders. In the patent specification it is indicated that the contour of the cam can be designed so that the pistons can be moved in a most favorable manner in connection with expansion of the combustion product. There is employed a desired level or steady contour for emptying or scavenging of exhaust before new fuel is introduced into the cylinder. In the drawings there is shown, in each of two mutually opposite cam grooves, a more or less rectilinear, local cam contour in mutual turning points lying directly opposite each other forming "sine"-like curve portions. More specifically the rectilinear cam contour is illustrated in only the one of two succeeding, turning points of the "sine"-like curve forming "sine"-like curve portions, namely where the respective pistons occupy one after the other their most remote outer positions with exhaust and scavenging ports open to the maximum.

Present Invention.

The present invention, which relates to two cycle engines, takes its starting point as to arrangement in a four cycle engine with piston and cylinder arrangement according to the afore-mentioned U.S. Pat. No. 5,031,581. In particular the aim according to the invention is to be able to adapt the "sine"-like concept to a two stroke engine, so that at least equally favorable and preferably still more favorable operating conditions can be achieved than what are attained in the four stroke (or two stroke) engine according to U.S. Pat. No. 5,031,581.

In a four cycle engine four respective strokes (air injection stroke, compression stroke, expansion stroke and exhaust rejection stroke) are employed one after the other, so that the different engine functions can be accommodated in each stroke, while in a two cycle engine the exhaust rejection and air injection take place in the transition zone between the expansion stroke and the compression stroke, that is to say in direct connection with remaining engine functions in each working sequence. With a two cycle engine different functions of the two oppositely directed cycles must consequently be combined.

According to the present invention the aim is also to combine the various engine functions in a two cycle engine in an especially favorable manner, in a particular design of the "sine"-like plane of the pistons, such as will be described in more detail below.

Inter alia the aim is, correspondingly as shown in a two cycle engine according to GB 2 019 487, to employ a more or less rectilinear contour in the turning point-forming "sine"-like curve portions where the pistons assume their most remote outer position with exhaust and scavenging ports open to the maximum.

According to the invention is employed the following combination:

that the "sine"-like plane does not need to have a curve contour, which lies as closely or tightest possible up to, but on the contrary can depart to a significant degree from a "sine"-like contour and from previously known "sine"-like contours, and that the cam guide devices can be designed with "sine"-like planes, which can vary to a significant degree mutually from each other, while in addition an especially favorable engine solution can be achieved totally.

The arrangement according to the invention is characterized in that the two pistons in each cylinder have mutually differing piston phases, which are controlled by mutually differing cam guide devices, the cam devices being designed with equivalent mutually differing "sine"-like planes, the respective cam guide devices of the two pistons are phase-displaced relative to each other in certain portions of the "sine"-like planes and in remaining portions of the "sine"-like planes are in mutual phase.

According to the invention there can be achieved an especially favorable control and thereby favorable accommodation of the different working functions in a two cycle engine.

Especially, it is made possible to accommodate the working functions at the top and/or bottom of the "sine"-curve in mutually different ways, whereas the respective intermediate "sine"-like curve portions can be arranged in common or more or less common manner.

Thereby on can ensure according to the invention movement of the pistons of the pair of pistons in a mutually differing manner, but nevertheless achieve favorable collective working conditions in a common working chamber between piston heads of the pair of pistons.

Phase Displacement of the Cam Guide Devices.

A practical, especially favorable solution according to the invention is achieved in that the respective cam guide devices of the two pistons, are phase-displaced relative to each other, in certain portions of the "sine"-like plane.

This means firstly, according to a first aspect of the present invention, an opportunity to extend the combustion phase in relation to the following compression phase respectively in relation to the preceding expansion phase by phase displacement of the "sine"-like curve tops.

According to a second aspect of the present invention a favorable, separate control of the scavenging air ports can be obtained via the cam guide device of the one piston and a correspondingly favorable, separate control of the exhaust ports via the cam guide device of the other piston. Consequently, by such phase displacement, the opening and closing of the scavenger ports and the exhaust ports at various points in time can be achieved and these points in time can be determined by equivalent designing of the individual cam guide device.

Stated in another manner the two pistons can separately open and close associated ports (exhaust ports/scavenger air ports), while the respective piston occupies a corresponding axial position in the associated cylinder, but by virtue of the mutual phase displacement between the piston movements, the opening and closing of the various ports can take place correspondingly phase-displaced.

Special Design of the "sine"-like Plane.

By designing a "sine"-like plane portion rectilinearly or largely rectilinearly in a plane at right angles to the driving axis of the engine, a hitherto disregarded possibility is obtained for creating especially favorable working conditions during the combustion phase of the fuel. According to the invention it will in fact be possible to define in the working chamber a particular combustion chamber corresponding to said working chamber portion by means of a particular design of the "sine"-like plane. This combustion chamber can consequently have a constant or approximately constant volume over a relatively large arcuate length of the longitudinal dimension of the "sine"-like plane and of the rotational arc of the drive shaft, so that large portions, for instance the whole or largely the whole of the combustion process can take place in said combustion chamber.

When it is indicated herein that the combustion chamber can have a constant or largely constant volume this has a connection with the detailed design of the "sine"-like plane at the dead point between the compression stroke and the expansion stroke.

In other words with an accurate rectilinear portion in the "sine"-like plane corresponding constant volumes can be obtained, while with a more or less rectilinear portion equivalent largely constant volumes can be obtained. This involves being able to adapt the contour of the "sine"-like plane according to practical conditions in different cases of application.

In practice partly rectilinear "sine"-like plane portions and partly preceding and subsequent, largely rectilinear "sine"-like plane portions can be employed.

By the afore-mentioned solution, which is based on a combustion chamber with a constant or largely constant volume in a dead portion at the transition from compression stroke to expansion stroke, one has firstly a chance of utilizing the energy collected which is generated in the combustion process and having full power even at the beginning of the expansion phase. Consequently said energy can be utilized with full effect immediately the respective piston has moved itself past its dead point or its dead portion. This discharge of energy can thereby be used at full strength already in said curved transition portion where the piston accelerates from the stationary to optimal piston movement and can thereafter continue at great strength in the following expansion phase.

Secondly, with such a combustion chamber having constant volume, one has the possibility of obtaining a more favorable combustion of the fuel, that is to say combustion of larger portions of the fuel, even before the expansion phase starts. This can be ensured by providing that considerable portions of the fuel are consumed in the combustion chamber in or just at said dead portion.

In addition a better utilisation of the energy of the fuel is obtained viewed totally, by being able to ensure that a higher portion of the fuel by way of percentage is consumed in the working chamber before exhaust gases are discharged from the working chamber at the close of the expansion stroke.

In other words there is the possibility according to the invention of increasing the output of the engine to a significant degree relative to previously known solutions.

According to the invention there is consequently obtained a generally greater engine output. In addition the escape of CO gas, NOX gas, and the like is reduced, and thereby a better environmental combustion is also obtained.

There must also be mentioned that after-combustion of the fuel, which occurs in the expansion stroke per se and which to a large degree can compensate for the volume enlargement in that portion of the working chamber where oscillation movements of the pistons take place, can be carried out according to the invention in a controlled manner in good time before the exhaust ports open, that is to say gradually as the expansion stroke propagates itself in the working chamber.

In other words one has a chance to distribute the motive power in an advantageous manner from the beginning of the expansion stroke and further through considerable portions of the expansion stroke before the exhaust ports open, even with an optimal combustion already before the expansion stroke.

The energy which is discharged, by the released possibility of movement of the pistons from the stationary condition, can consequently be discharged relatively momentarily and at full strength from a combustion chamber having a constant volume. The discharge itself can occur in an accelerating manner via a curved "sine"-like plane portion, which constitutes the transition portion between said rectilinear dead portion and a subsequent rectilinear expansion portion. In the subsequent rectilinear expansion portion, the expansion takes place linearly, that is to say in a working chamber having roughly speaking a linear increasing volume.

ILLUSTRATION BY DRAWINGS

Further features of the present invention will be evident from the following description having regard to the accompanying drawings, which show some practical embodiments and in which:

FIG. 1 shows a vertical section of an engine according to the invention.

FIGS. 1*a* and 1*b* show in a corresponding segment of FIG. 1 vital parts of the engine and illustrate in FIG. 1*a* pistons of the engine in a position with maximum mutual spacing and in FIG. 1*b* pistons of the engine in a position with minimal mutual spacing.

Figure 4A:
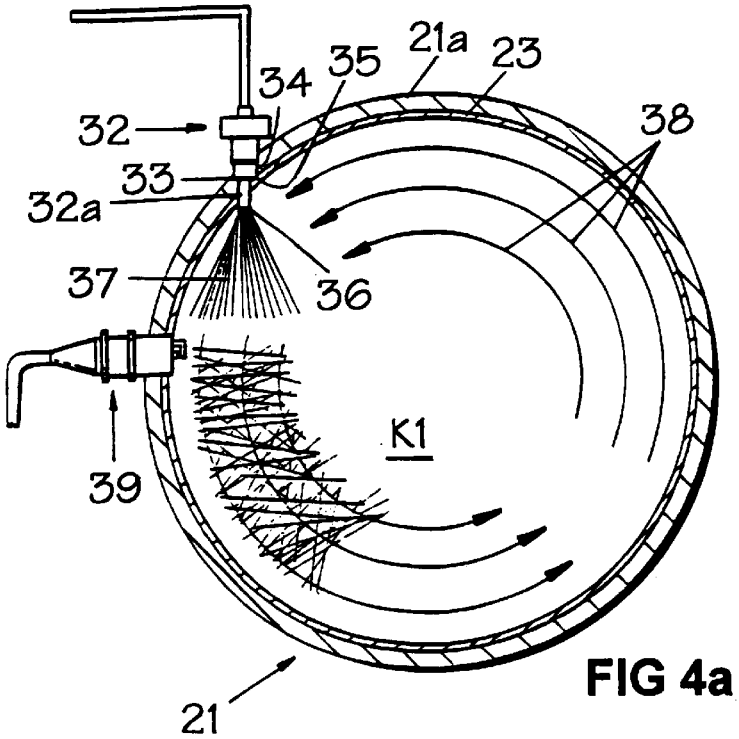

FIG. 4*a* shows schematically in a third cross-section, the middle portion of the engine cylinder, where the fuel is supplied and the ignition of the fuel occurs, illustrated in a first embodiment.

Figure 4B:
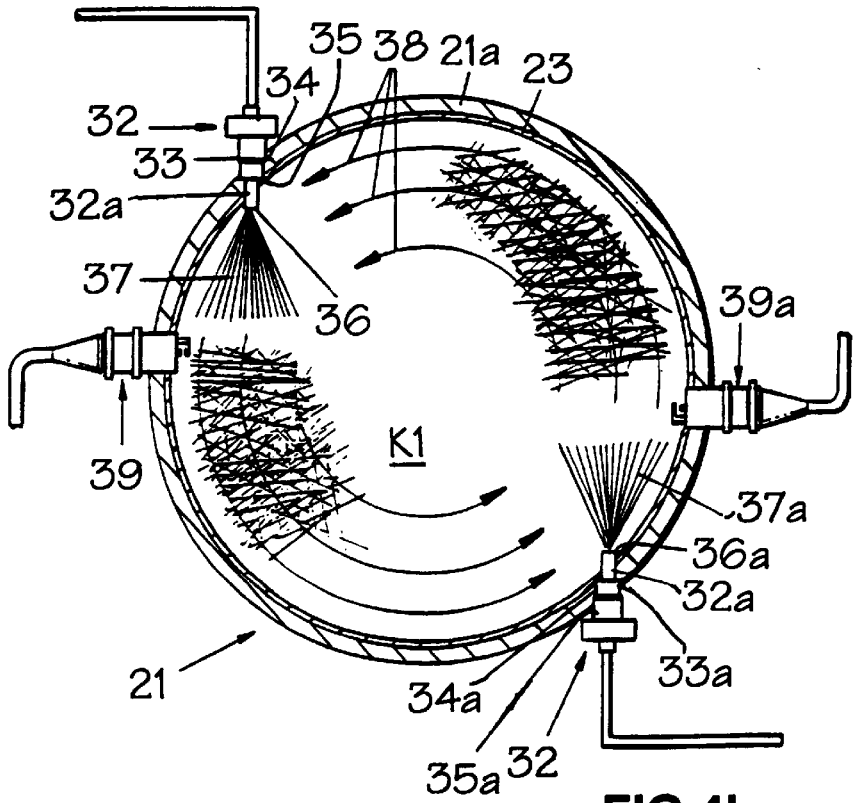

FIG. 4*b* shows in a cross-section, which corresponds to FIG. 4*a*, the middle portion of the cylinder according to a second embodiment.

Figure 1:
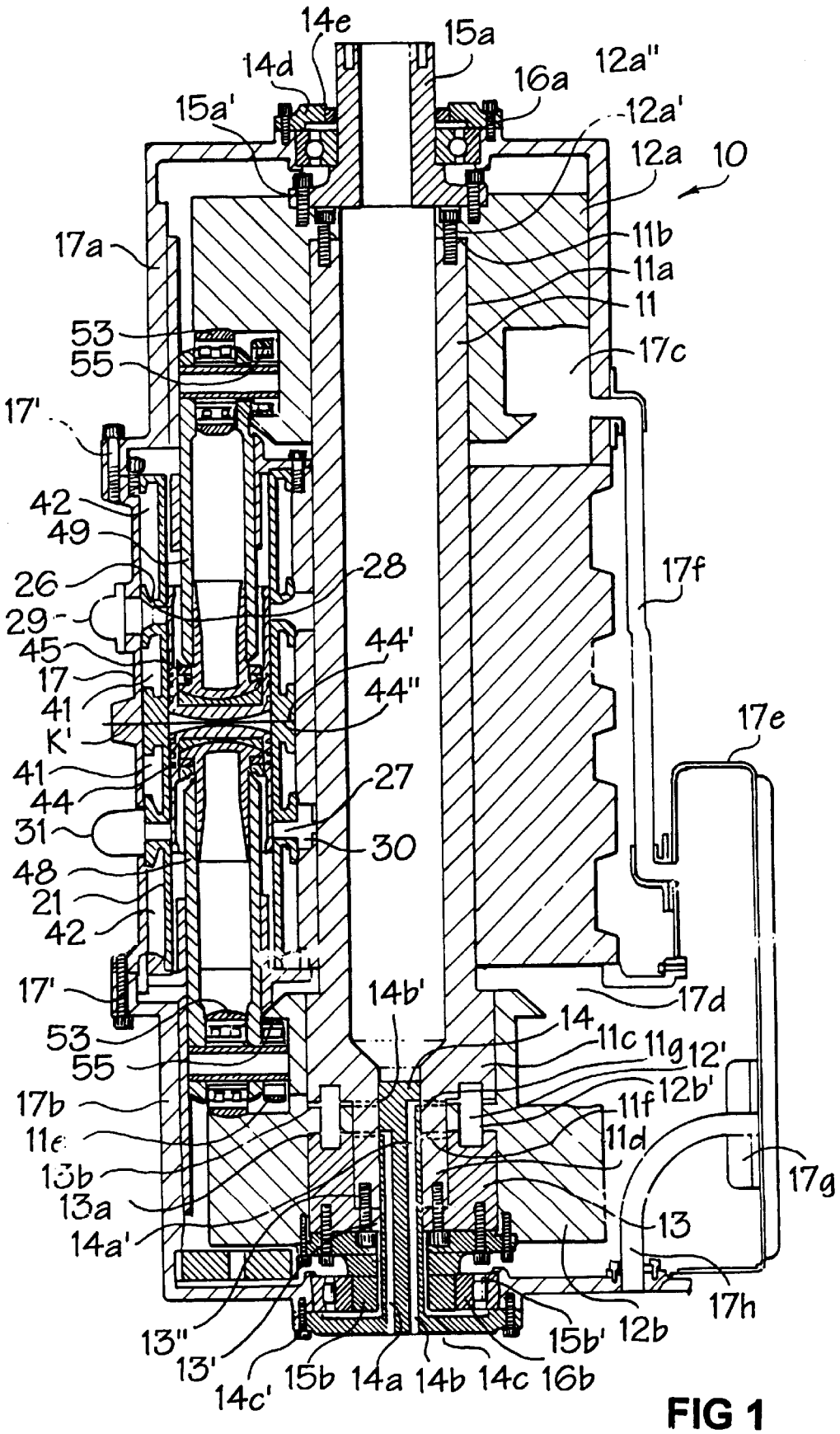
Figure 1A:
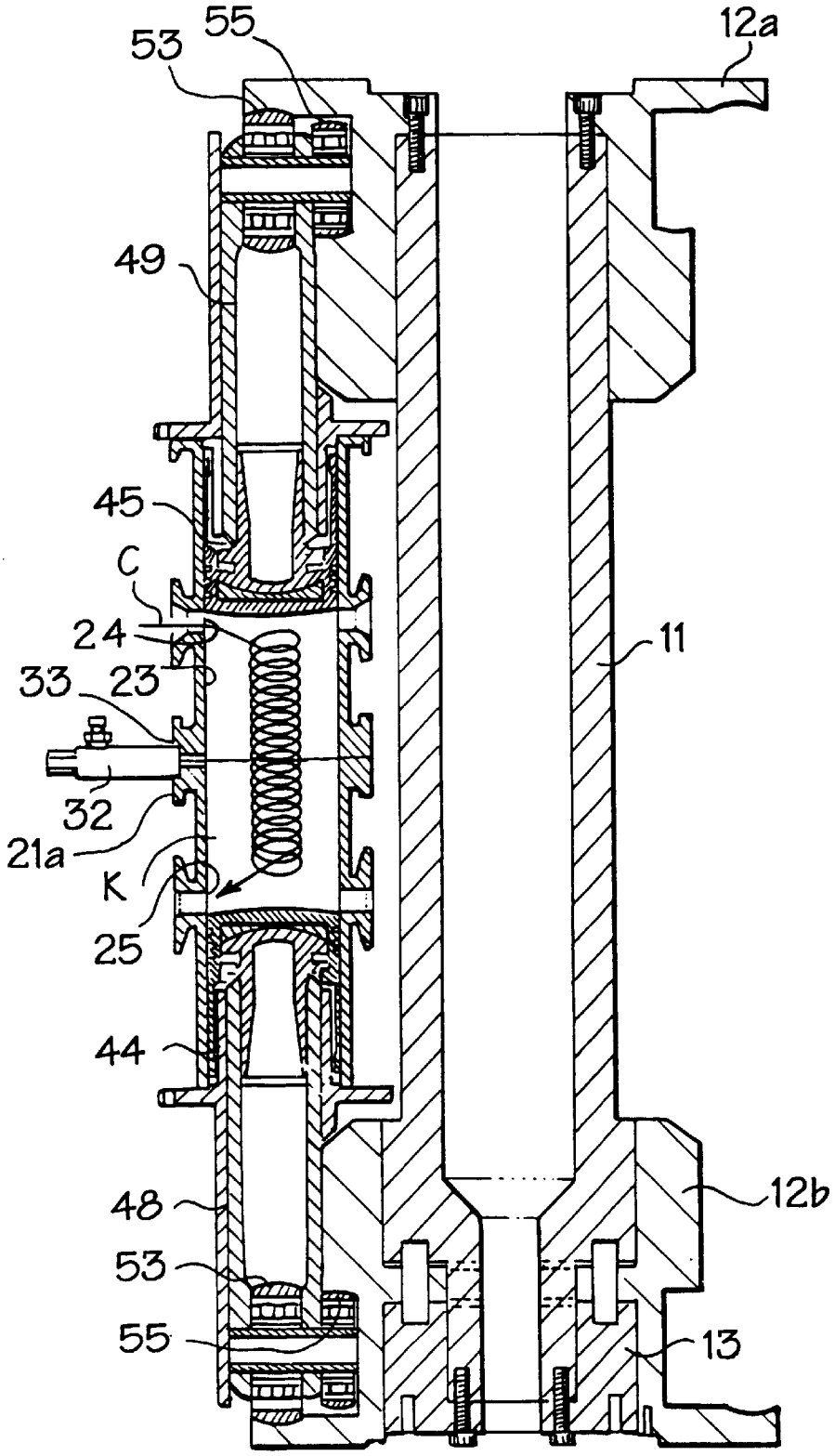
Figure 1B:
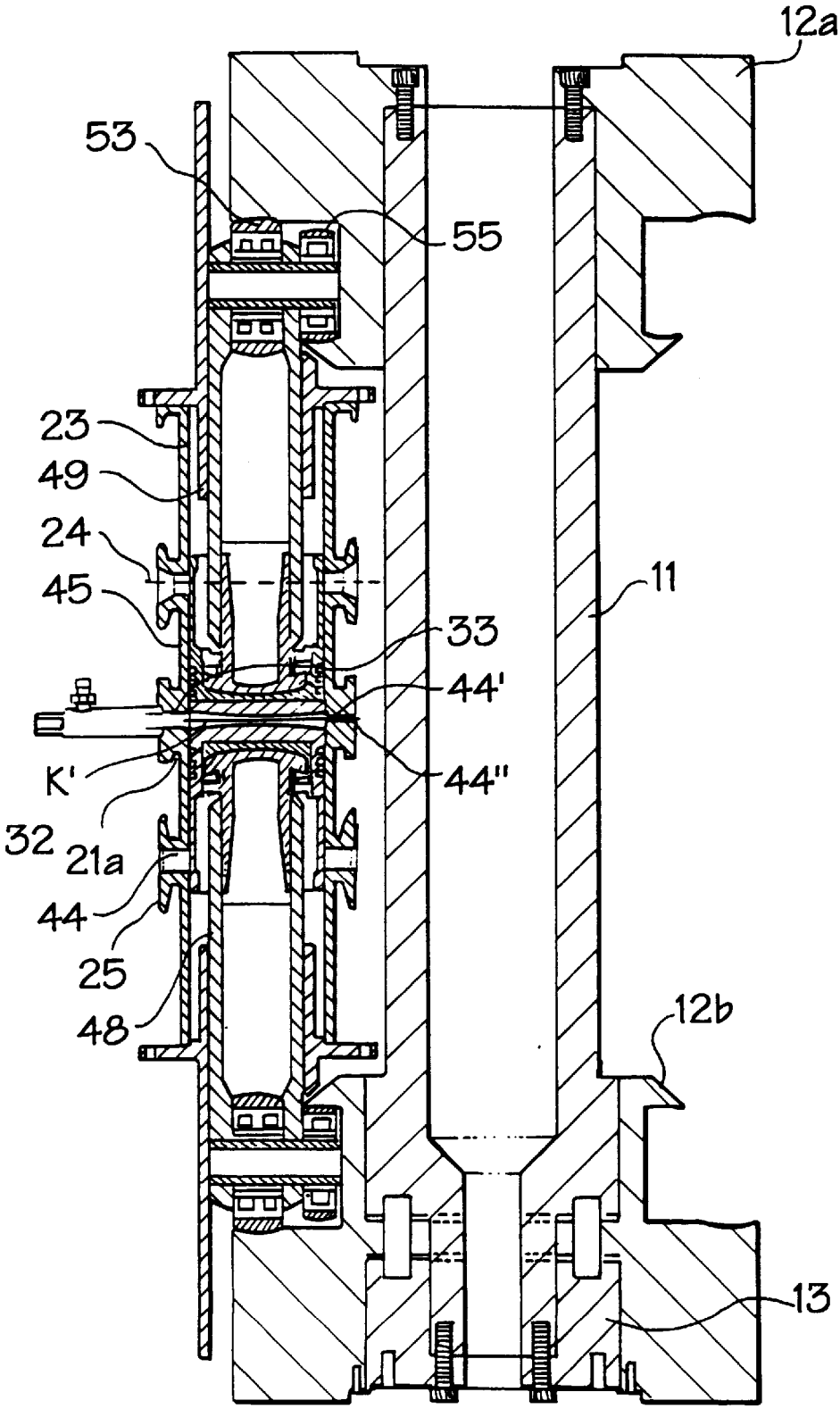
Figure 5A:
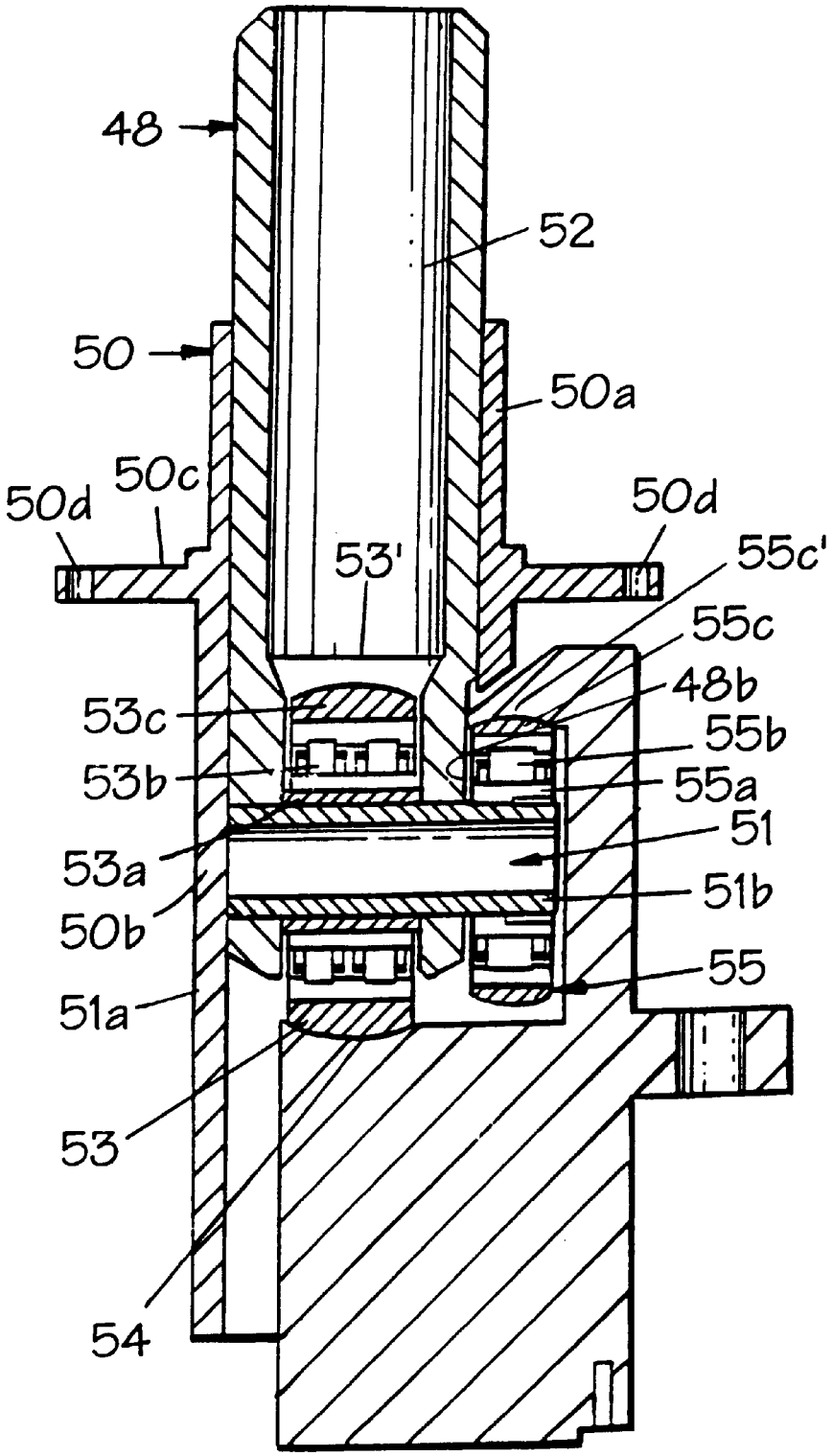

FIG. 5*a* shows in longitudinal section a segment of the engine according to FIG. 1*b*.

Figure 5B:
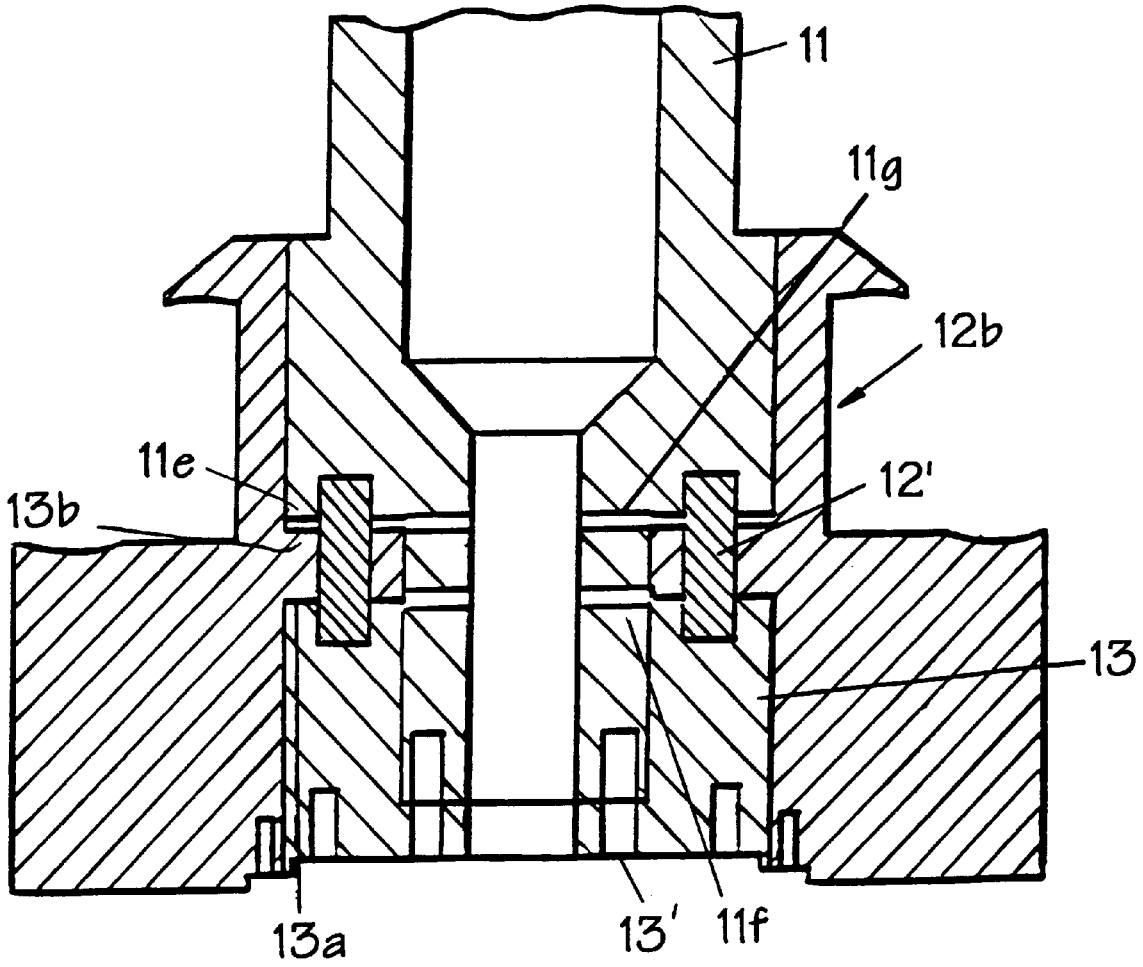

FIG. 5*b* shows a cam guide device with associated drive shaft, illustrated in longitudinal section with a segment of the engine according to FIG. 1*b*.

Figure 5D:
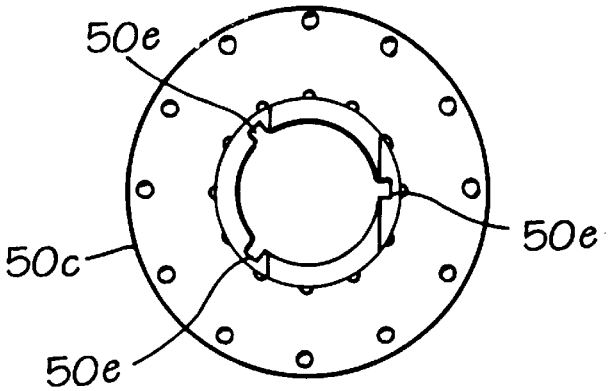
Figure 5C:
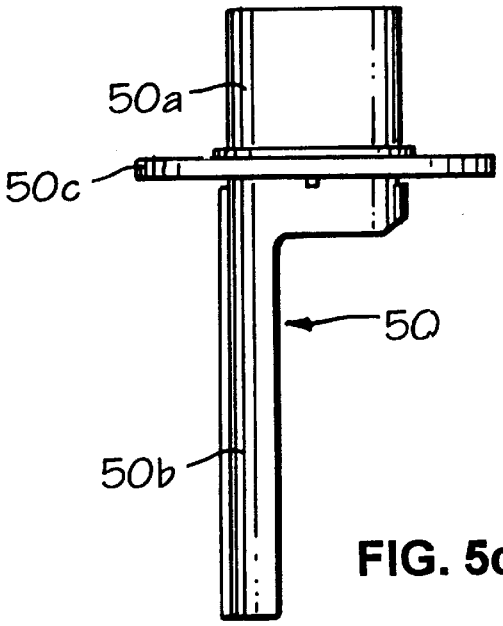

FIG. 5*c* shows a cross head in side view.

Figure 5E:
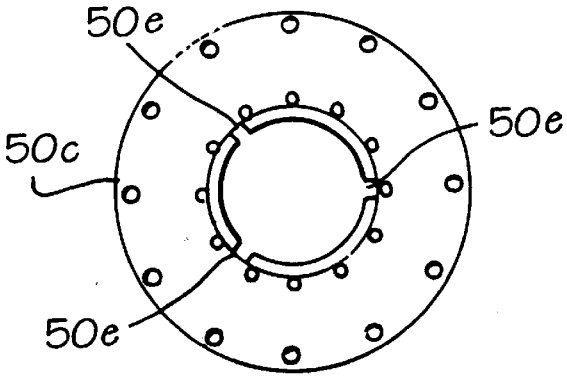

FIGS. 5*d* and 5*e* show the cross head according to FIG. 5*c* seen respectively from above and below.

Figure 5F:
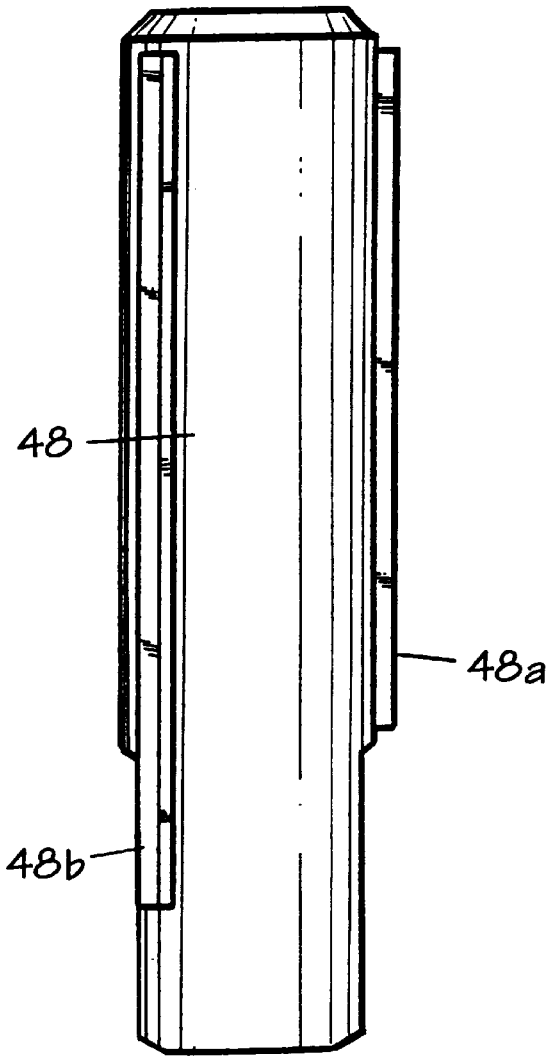

FIG. 5*f* shows the piston rod seen in side view.

Figure 5G:
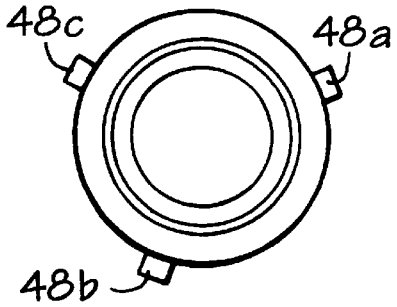

FIG. 5*g* shows the piston rod according to FIG. 5*f* seen from above.

Figure 5H:
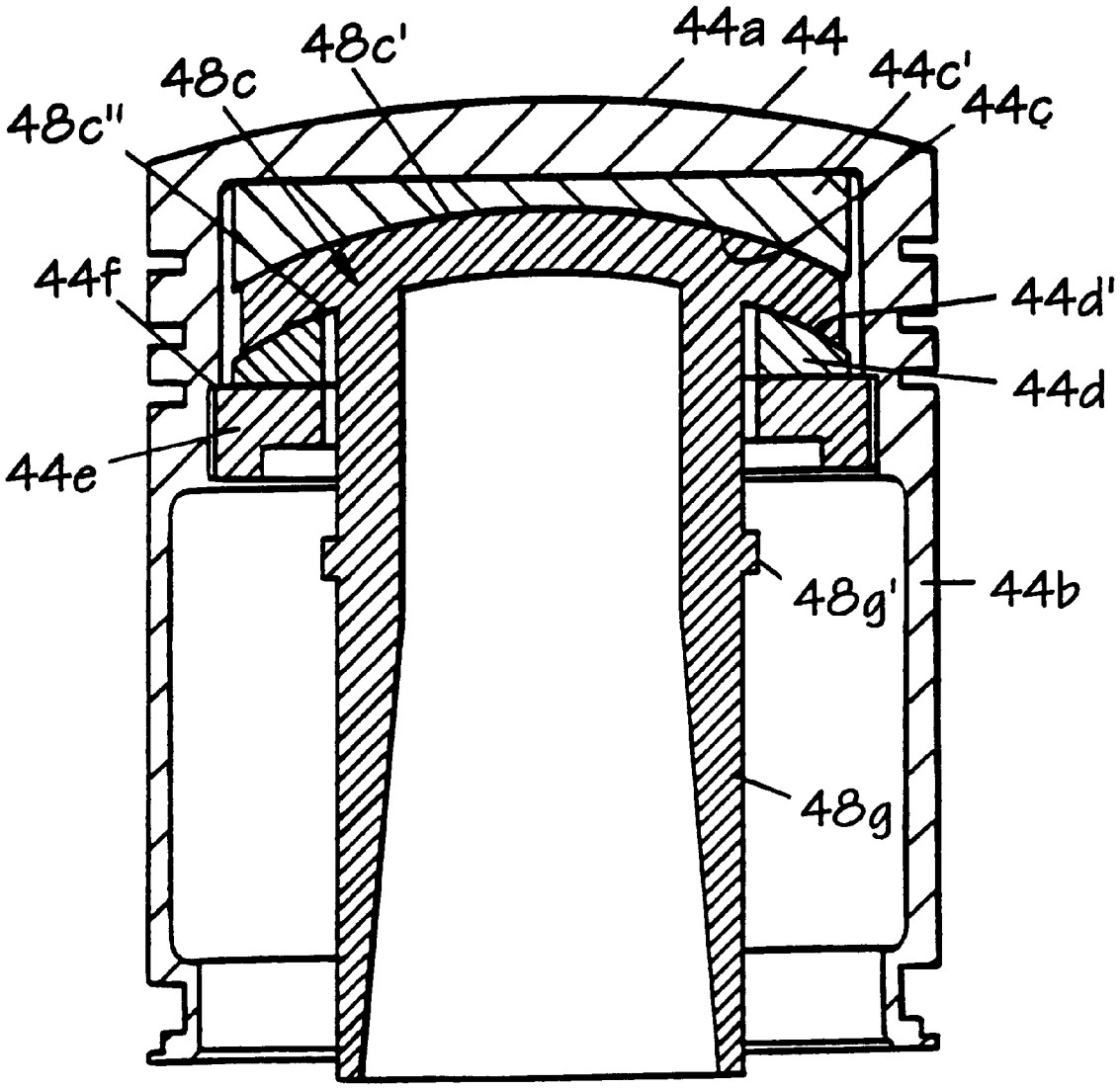

FIG. 5*h* shows a piston according to the invention in vertical section.

Figure 6:
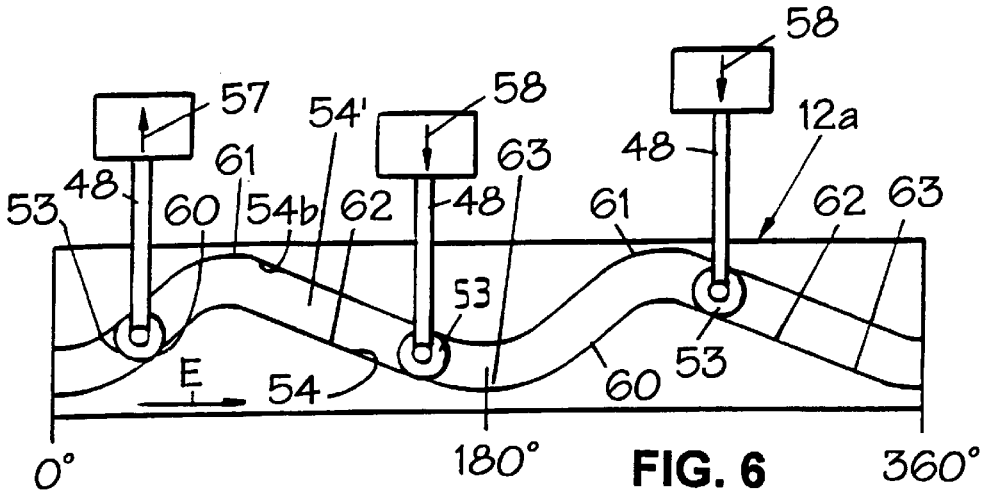
Figure 7:
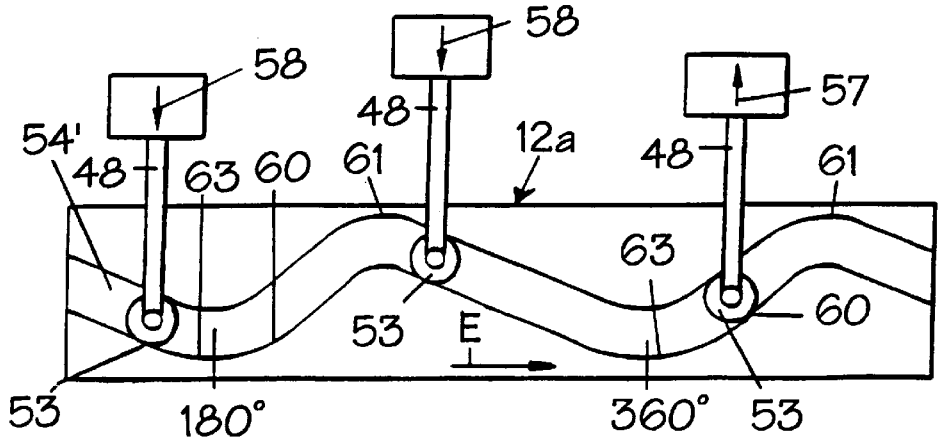
Figure 8:
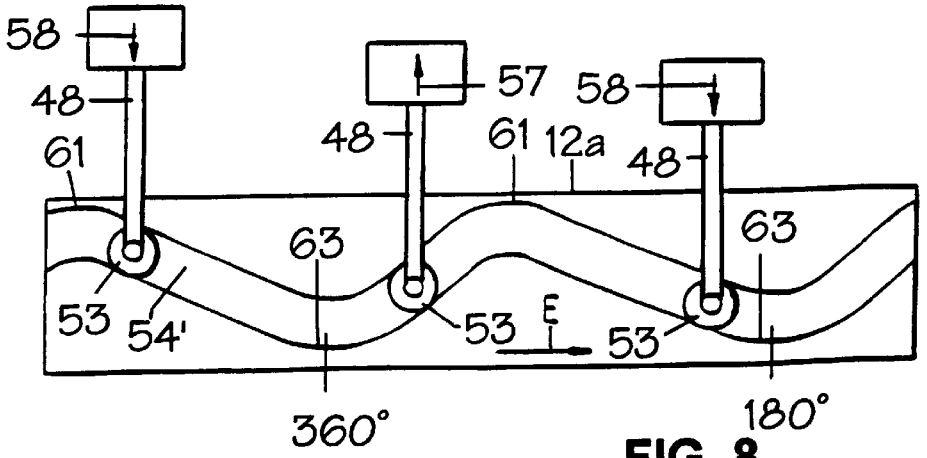

FIGS. 6–8 show schematically illustrated and spread in the plane of the drawing a general pattern of movement for a first of two pistons associated with each cylinder, used in connection with a three cylinder engine, and illustrated in different angular positions relative to the rotary movement of the drive shaft.

Figure 6A:
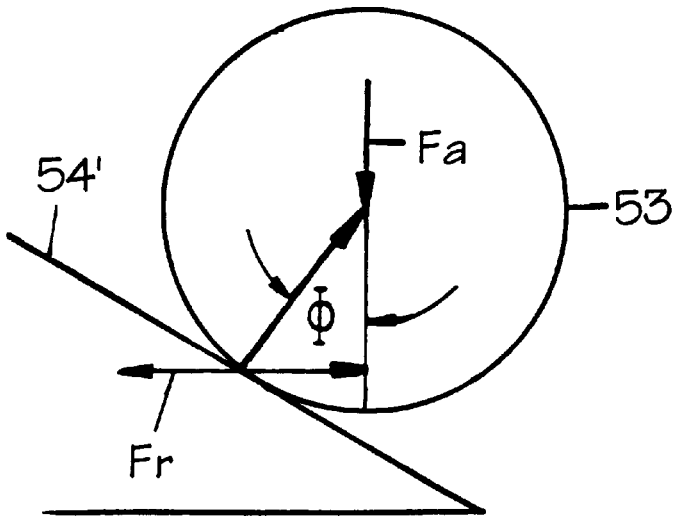

FIG. 6*a* shows schematically the principle for transferring motive forces between the roller of the piston rod and an associated obliquely extending portion of a "sine"-like plane.

Figure 9:
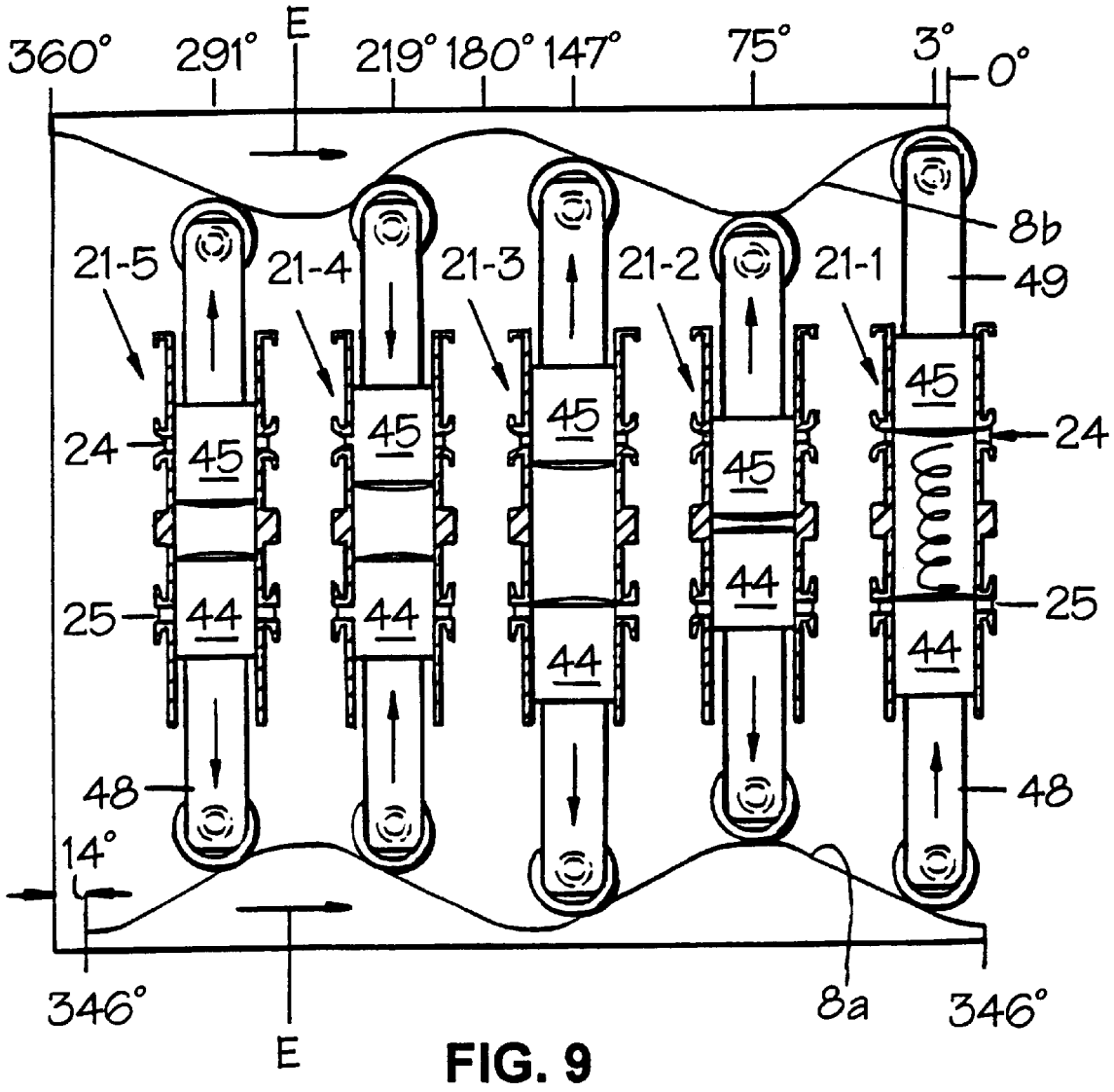

FIG. 9 shows schematically illustrated and spread in the plane of the drawing a more detailed pattern of movement for two pistons of each cylinder, illustrated in different angular positions relative to the rotary movement of the drive shaft, illustrated in connection with a five cylinder engine.

Figure 10:
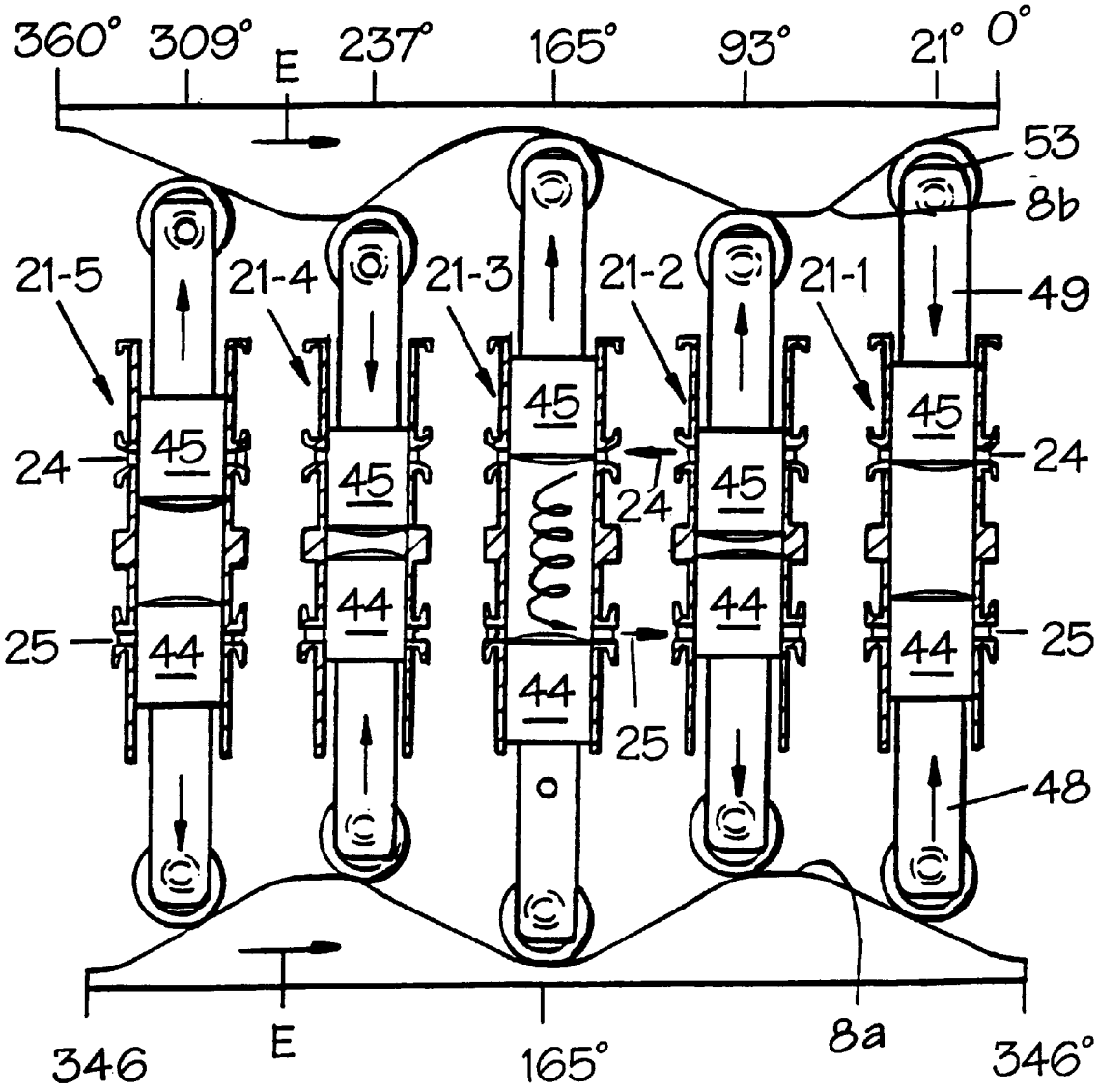

FIG. 10 shows in a representation corresponding to FIG. 9, the pistons in respective positions relative to associated cylinders, in a subsequent working position.

Figure 11:
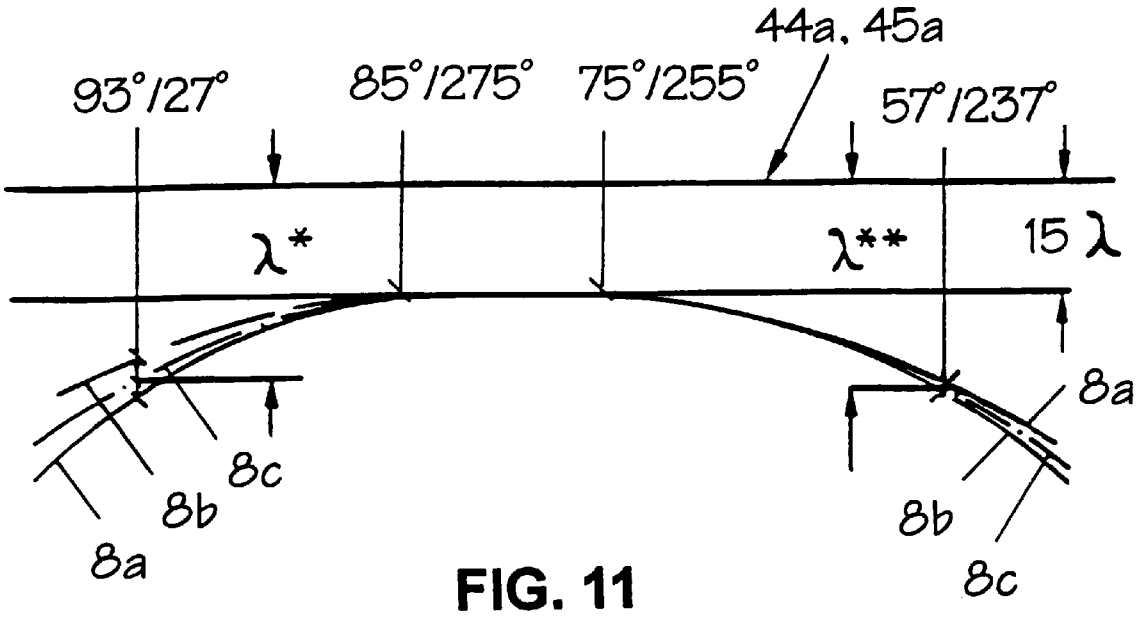

FIG. 11 shows schematically a segment of a central portion of a "sine"-like plan for two associated pistons of each cylinder.

Figure 12:
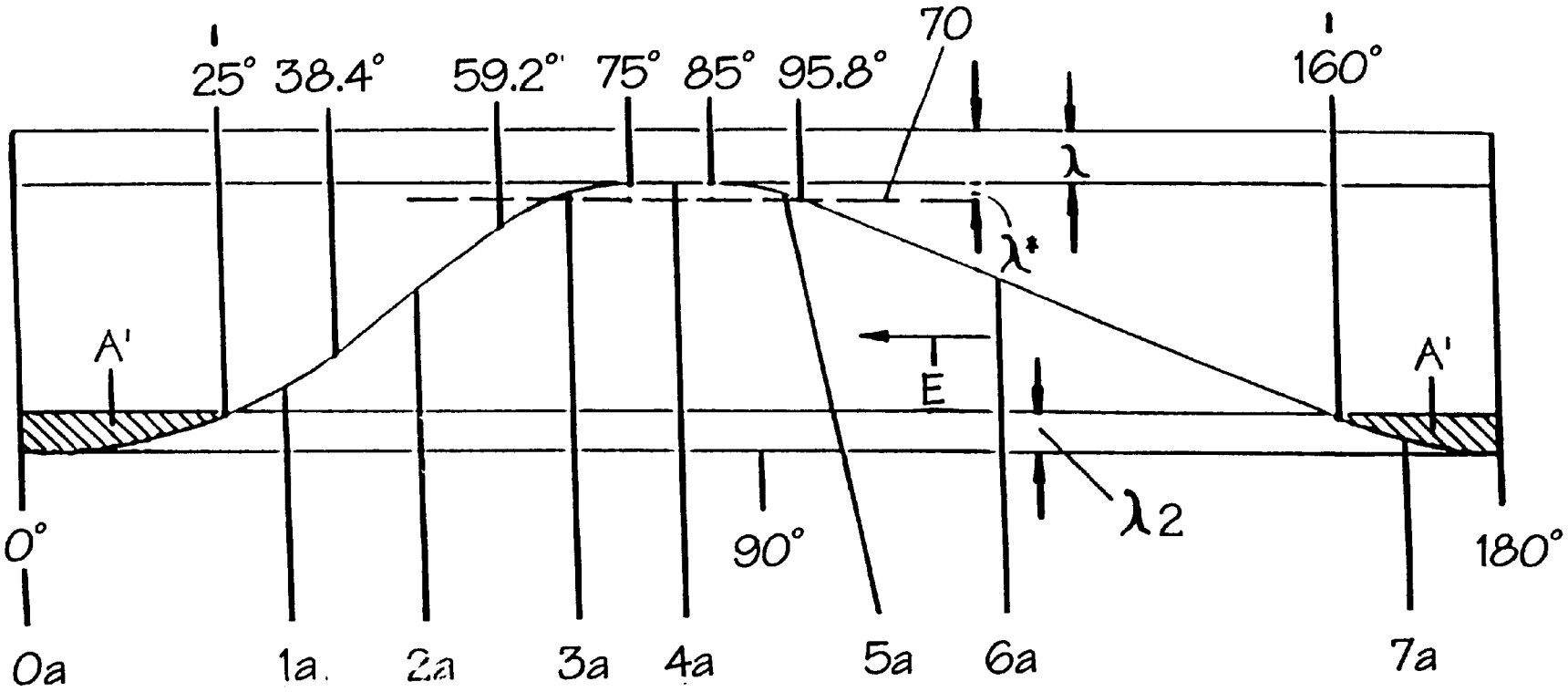

FIG. 12 shows a detailed curve contour for a "sine"-like plane for a first piston in each cylinder.

Figure 13:
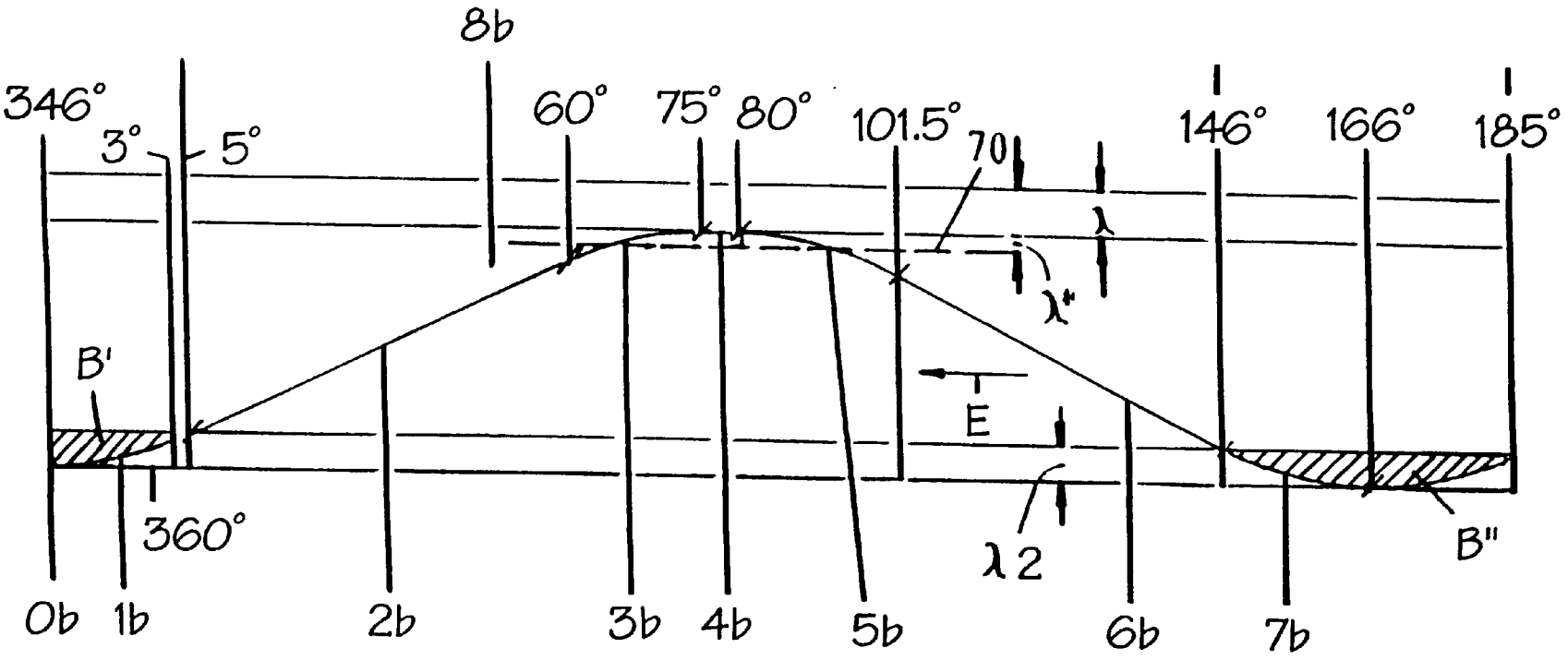

FIG. 13 shows a corresponding detailed curve contour for a "sine"-like plan for a second piston in each cylinder.

Figure 14:
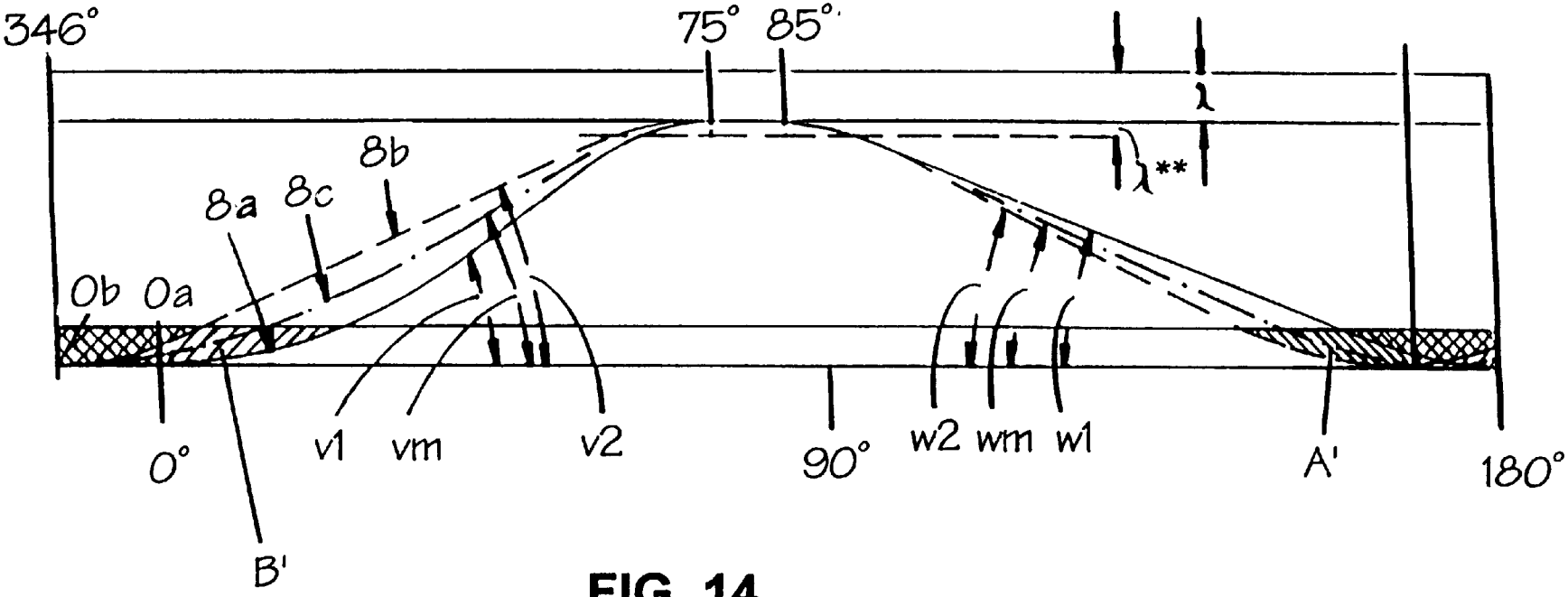

FIG. 14 shows a comparative compilation of the curve contours according to FIGS. 12 and 13.

Figure 15:
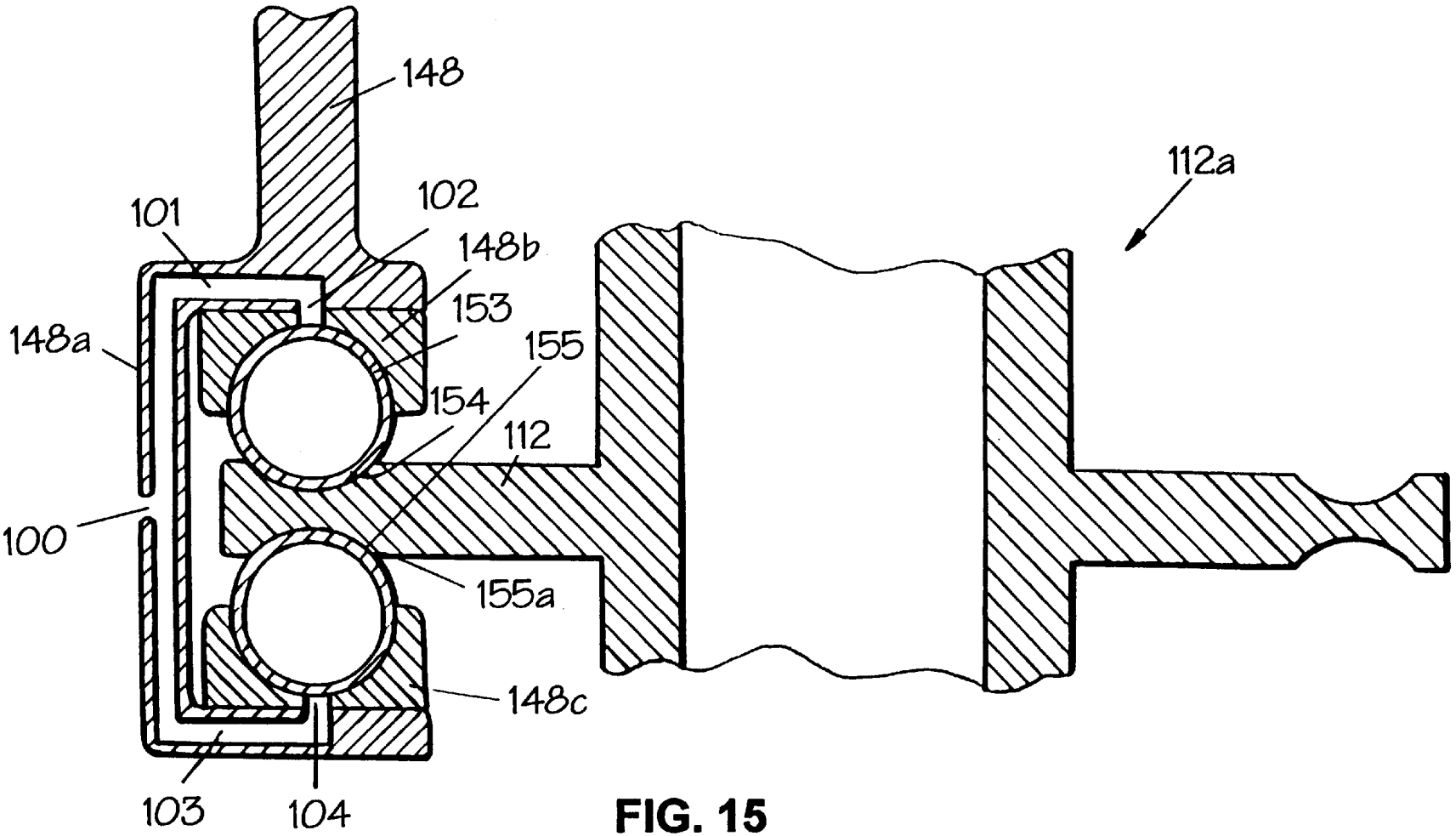

FIG. 15 shows in section and in longitudinal section an alternative construction of a cam guide device with associated pressure rollers arranged at the outer end of a piston rod.

Figure 16:
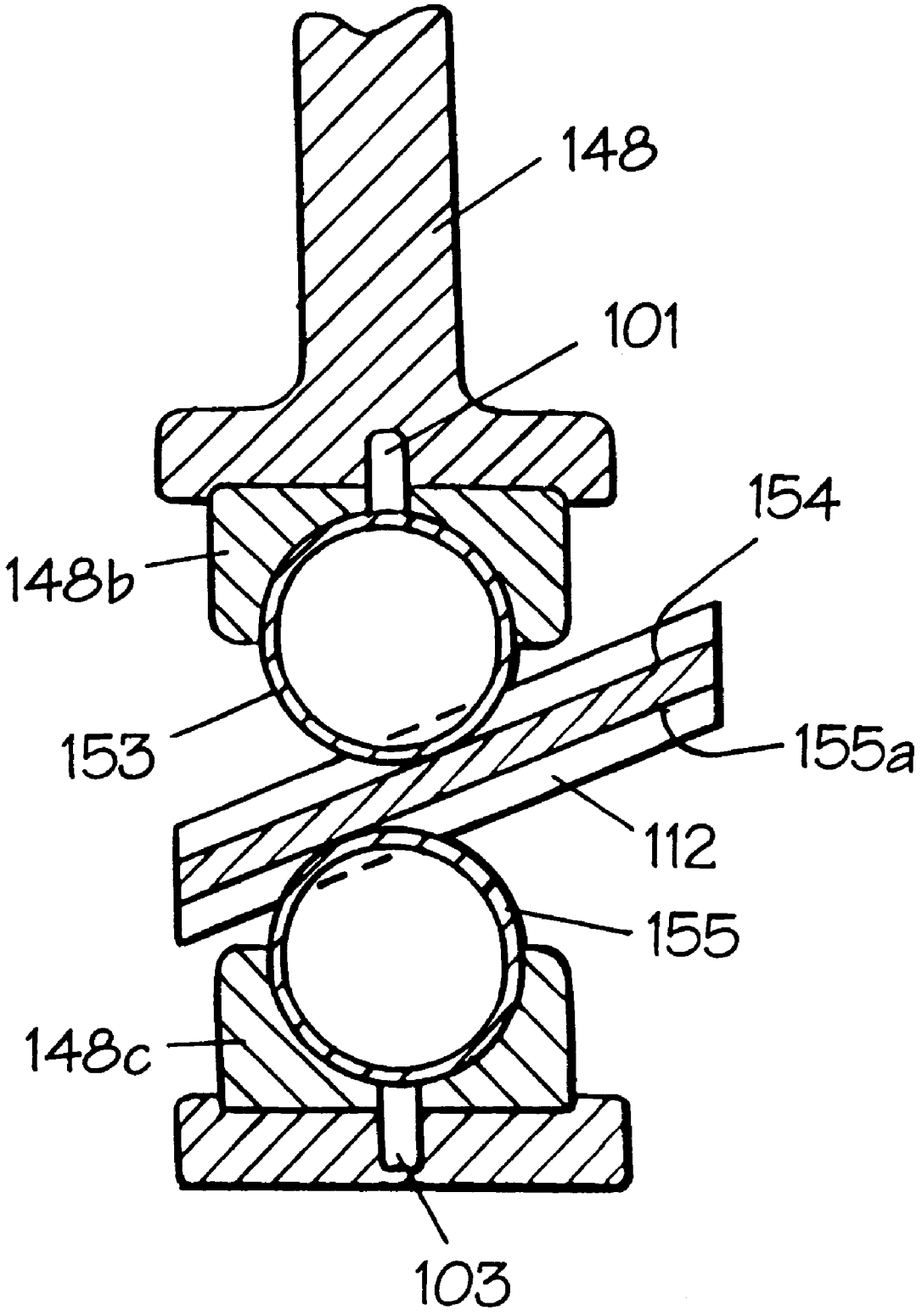

FIG. 16 shows the same alternative solution, as illustrated in FIG. 15, shown in section in a direction radially outwards from the cam guide device.

Figure 17:
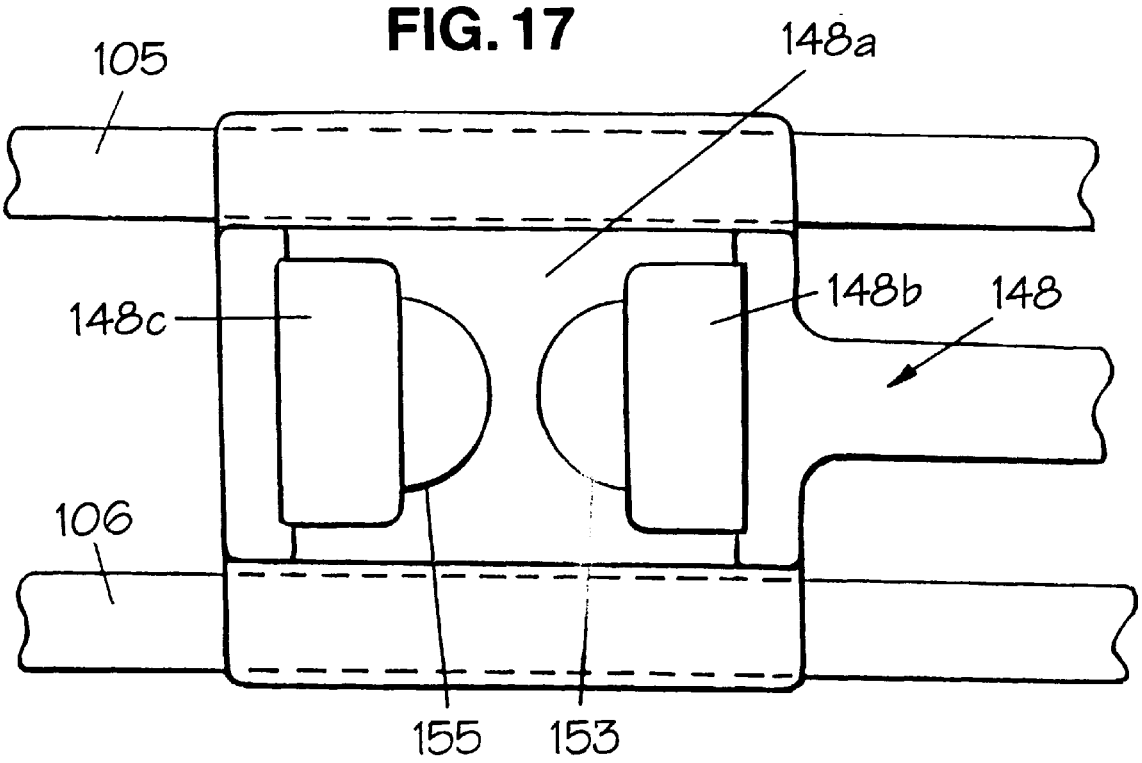
Figure 18:
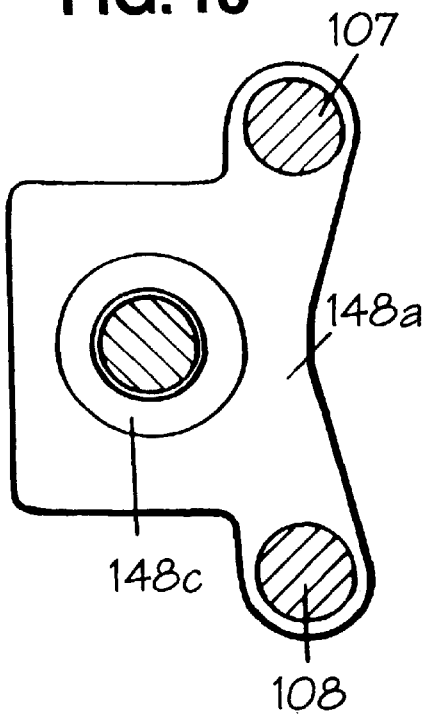

FIGS. 17 and 18 show in elevation and in horizontal section respectively the guiding of the head portion of the piston rod along a pair of control bars extending mutually in parallel.

In connection with FIG. 1 reference herein shall generally be made to a two cycle combustion engine 10 having internal combustion. Especially there will be described such an engine 10 adapted according to a so-called "sine"-like concept. In FIG. 1 there is specifically shown a combustion engine 10 according to the invention illustrated in cross-section and in a schematic manner.

According to the invention the aim according to a first aspect of the invention is combustion in a specially defined combustion chamber K1 (see FIG. 1*b*), as will be described in more detail below.

Furthermore according to a second aspect according to the invention the aim is a favorable control of opening and closing exhaust ports 25 and scavenging ports 24, as will be described further below.

In the embodiment illustrated in FIG. 1 there is shown a drive shaft 11 in the form of a pipe stump, which passes axially and centrally through the engine 10.

The drive shaft 11 is provided at its illustrated one end with a radially outwardly projecting, first head portion 12*a*, which forms a first cam guide device. at its other illustrated end the drive shaft 11 is provided with an equivalent radially outwardly projecting, second head portion 12*b*, which forms a second cam guide device.

The head portions/the cam guide devices 12*a*,12*b* in the illustrated embodiment are represented separately and are connected separately to the drive shaft 11 each with their fastening means.

The cam guide device 12*a* surrounds the drive shaft 11 at its one end 11*a* and forms an end support against end surface 11*b* of the drive shaft 11 via a fastening flange 12*a*' and is stationarily secured to the drive shaft via fastening screws 12*a*".

The cam guide device 12*b* surrounds a thickened portion 11*c* of the drive shaft 11 at its opposite end portion 11*d*. The cam guide device 12*b* is not, as is the cam guide device 12*a* directly secured to the drive shaft 11, but is on the other hand arranged axially displaceable a limited extent axially along the drive shaft 11, especially with the idea of being able to regulate the compression ratio in cylinders 21 of the engine 10 (only the one of a number of cylinders is shown in FIG. 1).

End portion 11*d* (see FIGS. 1 and 5*a*) of the drive shaft 11 forms a radially offset sleeve portion to which there is fastened cup-shaped carrying member 13. The carrying member 13 is provided with a fastening flange 13' which with fastening screws 13" is secured to end portion 11*d* of the drive shaft 11. Between upper end surface 13*a* of the carrying member 13 and an opposite shoulder surface 11*e* of the drive shaft 11 there is defined a pressure oil chamber 13*b*. In the pressure oil chamber 13*b* there is slidably received a compression simulator 12*b*' in the form of a piston-forming guide flange, which projects from the inner side of the cam guide device radially inwards into the pressure oil chamber 13*b* for sliding abutment against the outer surface of the end portion 11*d*.

In order to prevent mutual turning between the cam guide device 12*b* and the carrying member 13 and the drive shaft 11 the guide flange 12*b*' is passed through by a series of guide pins 12' which are anchored in their respective bores in the end surface 13*a* of the carrying member 13 and in the shoulder surface 11*e* of the drive shaft 11.

The pressure oil chamber 13*b* is supplied pressure oil and is drained of pressure oil via transverse ducts 11*f* and 11*g* through end portion 11*d* of the drive shaft 11.

An oil guide means 14, which is put axially inwards into mutually aligned axial bores in the end portion 11*d* of the drive shaft 11 and in fastening flange 13' of the carrying member 13, provides for pressure oil and return oil to be led to and from the ducts 11*f* and 11*g* via separate guide ducts 14*a* and 14*b* and adjacent annular grooves 14*a*' and 14*b*' in the oil guide means 14.

Control of pressure oil and return oil to an from the pressure oil chamber 13*b* on opposite sides of the compression simulator 12*b*' of the cam guide device 12*b* takes place from a remotely disposed commercially conventional control arrangement, not shown further, in a manner not shown further.

The drive shaft 11 is, as shown in FIG. 1, connected at opposite ends to equivalent drive shaft sleeves 15*a* and 15*b*. The sleeve 15*a* is fastened with fastening screws 15*a*' to the cam guide device 12*a*, while the sleeve 15*b* is fastened with fastening screws 15*b*' to the carrying member 13. The sleeves 15*a* and 15*b* are rotatably mounted in a respective one of two opposite main support bearings 16*a*,16*b*, which are fastened at opposite ends of the engine 10 in a respective end cover 17*a* and 17*b*.

As shown in FIG. 1, the end covers 17*a* and 17*b* are correspondingly fastened to an intermediate engine block 17 by means of fastening screws 17'.

Internally in the engine 10 a first lubricating oil chamber 17*c* is defined between the end cover 17*a* and the engine block 17 and a second lubricating oil chamber 17*d* between the end cover 17*b* and the engine block 17. There is shown an extra cap 17*e* attached to the end cover 17*b* and an external oil conduit 17*f* between the lubricating oil chamber 17*c* and the oil cap 17*e*. Further there is illustrated a suction strainer 17*g* connected to a lubricating oil conduit 17*h* which forms a communication between the lubricating oil chamber 17*d* and an external lubricating oil arrangement (not shown further).

The oil guide means 14 is provided with a cover-forming head portion 14*c* which is fastened to end cover 17*b* of the engine 10 with fastening screws 14*c*'. The cover-forming head portion 14*c* forms a sealing off relative to the lubricating oil chamber 17*c* endwise outside the support bearing 16*b*. Correspondingly there is fastened to the end cover 17*a* endwise outside the support bearing 16*a* a sealing cover 14*d* with associated sealing ring 14*e*.

The engine 10 is consequently generally constructed of a driven component, that is to say a rotatable component, and a driving component, that is to say a non-rotating component. The driven component comprises drive shaft 11 of the engine and carrying member 13 of the drive shaft and drive shaft sleeves 15*a*,15*b* plus the cam guide devices 12*a* and 12*b*, which are connected to the drive shaft 11. The driving, non-rotating component comprises cylinders 21 of the engine with associated pistons 44,45.

According to the present invention there is ensured a regulation of the compression ratio of the engine by effecting a regulation internally, that is to say mutually between the parts of the driven component. More specifically the one cam guide device 12*b* is displaced axially backwards and forwards relative to the drive shaft 11, that is to say within the defined movement space in said pressure oil chamber 13*a*, which is determined by the guide flange 12*b*' and the part-chambers of the oil chamber 13*a* on opposite sides of the guide flange 12*b*'.

In practice it is a question of a regulation length of some few millimeters for smaller motors and of some centimeters for larger engines. The respective volume differences of the associated working chambers have however equivalent compression effects in the different engines.

For instance a stepwise or stepless regulation of the compression ratios can be considered according to need, for example adapted with graduated control of the cam guide device 12*b* to respective positions relative to the drive shaft 11. The control can for example occur automatically by means of electronics known per se, based on different temperature sensing equipment, and the like. Alternatively the control can occur by manual control via suitable regulation means, which are not shown further herein.

By effecting the regulation of the cam guide device 12*b* in connection with the driven component of the engine, one avoids influence on the general control of the arrangement of associated piston 44, piston rod 48, main support wheel 53 and auxiliary wheel 55, that is to say influence on the mechanical connection between the driving component and the driven component is avoided.

On the other hand, with such a regulation of the cam guide device 12*b*, there is obtained an axial regulation internally in the driving component, in such a way that the arrangement of piston 44, piston rod 48, main support wheel 53 and auxiliary wheel 55 can be displaced collectively via the cam guide device 12*b* relative to the associated cylinder 21, independently of the concrete compression regulation in practice.

In FIGS. 1 and 1*b* there is indicated by a broken line a centre space 44' between the piston heads of the pistons 44,45 at a normal compression ratio when the cam guide device 12*b* occupies the position illustrated in FIG. 1. By the full line there is indicated a centre space 44" between the piston heads of the pistons 44,45 when guide flange 12*b*' of the cam guide device 12*b* is pushed to the maximum upwardly against the shoulder surface 11*e* of the piston rod 11.

The engine 10 is shown divided up into three stationary main components, that is to say a middle member, which constitutes the engine block 17 and two cover-forming housing members 17*a*,17*b* which are arranged at a respective one of the ends of the engine 10. The housing members 17*b*, 17*c* are consequently adapted to cover their respective cam guide devices 12*a*,12*b*, support wheels 53 and 55 and their associated bearings in respective piston rods 48,49 at their respective end of the engine block 17. All the driving and driven components of the engine are consequently effectively enclosed in the engine 10 and received in an oil bath in the associated lubricating oil chambers 17*c* and 17*d*.

In the engine block 17 in the illustrated embodiment, there is used in connection with a three cylinder engine, correspondingly designed with three peripherally separated engine cylinders 21. Only the one of the three cylinders 21 is shown in FIGS. 1, 1*a* and 1*b*.

The three cylinders 21, which are placed around the drive shaft 11 with a mutual angular spacing of 120°, are designed according to the illustrated embodiment as separate cylinder-forming insert members, which are pushed into an associated bore in the engine block 17.

In each cylinder/cylinder member 21 there is inserted a sleeve-shaped cylinder bushing 23. In the bushing 23 there is designed, as shown further in FIGS. 1*a* and 1*b* (see also FIGS. 2 and 3), an annular series of scavenging ports 24 at one end of the bushing 23 and an annular series of exhaust ports 25 at the other end of the bushing 23.

Figure 2:
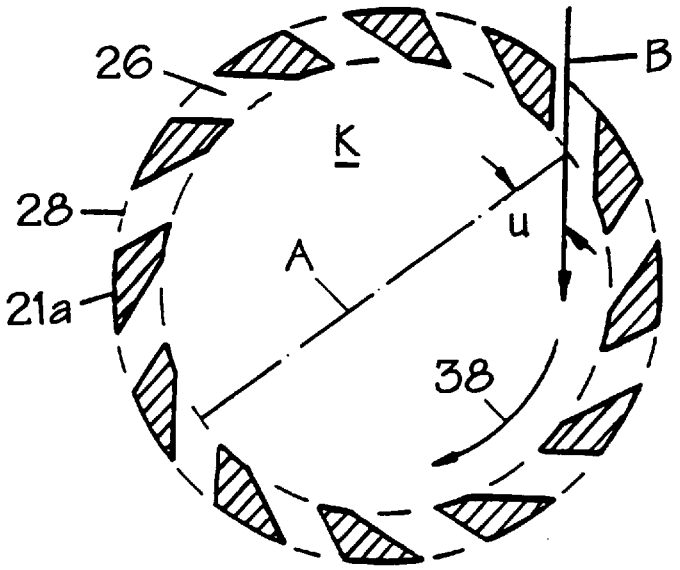
FIG. 2 shows schematically a first cross-section illustrated at one end of the cylinder of the engine in which there is shown a scavenging air intake.
Figure 3:
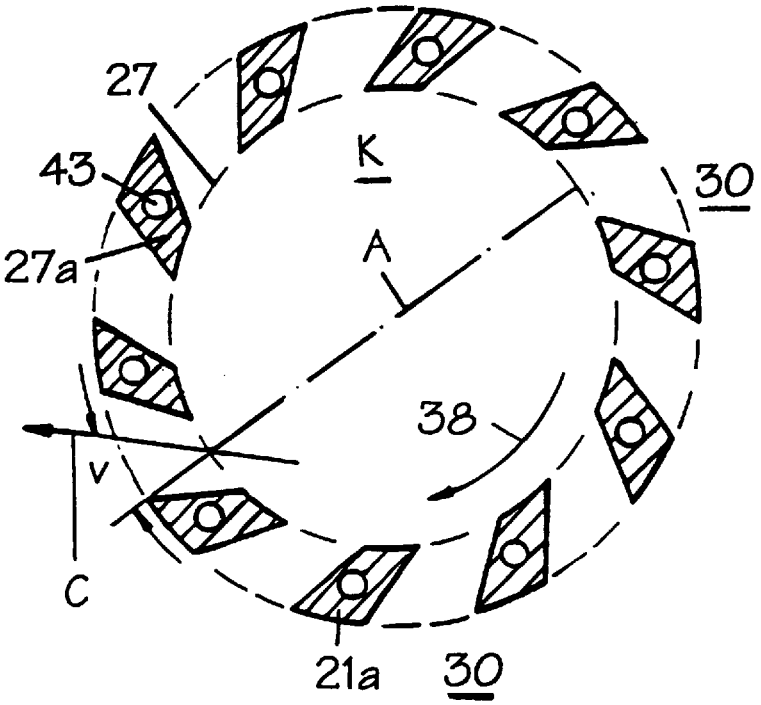
FIG. 3 shows schematically a second cross-section illustrated at the other end of the cylinder of the engine, in which there is shown an exhaust outlet.

Equivalently in wall 21*a* of the cylinder 21 there are arranged scavenging ports 26, which are radially aligned with scavenging ports 24 of the bushing 23, as is shown in FIG. 2, while exhaust ports 27, which are radially aligned with exhaust ports 25 of the bushing 23, are equivalently designed in the cylinder wall 21*a*, as is shown in FIG. 3.

In FIG. 1 there is shown an annular inlet duct 28 for scavenging air, which surrounds the scavenging ports 26, and a scavenging air intake 29 lying radially outside.

As is shown in FIG. 2 the scavenging air ducts 28 extend at a significant oblique angle u relative to a radial plane A through the cylinder axis, specially adapted to put the scavenging air in a rotational path 38 internally in the cylinder 21, as is shown by an arrow B in FIG. 2.

There is further shown in FIG. 1 an annular exhaust outlet duct 30, which surrounds the exhaust ports 27, plus an exhaust outlet 31 emptying radially outwards.

In FIG. 3 there is shown an equivalent oblique run of the exhaust ports 27 at an angle v relative to the radial plane A through the cylinder axis, specially adapted to lead the exhaust gases from the rotational path 38 internally in the cylinder in an equivalent rotational path outwards from the cylinder 21, as is shown by an arrow C. The exhaust ports 27 are shown opening radially outwards to facilitate the outward flow of the exhaust gas from the cylinder 21 outwards towards the exhaust outlet duct 30.

In the conventionally known manner the scavenging air is used to push out exhaust gas from a preceding combustion phase in the cylinder, in addition to supplying fresh air for a subsequent combustion process in the cylinder. In this connection there is employed according to the invention in a manner known per se a rotating air mass as shown by arrows 38 (see FIGS. 1*a* and 4*a*) in working chamber K of the cylinder 21 in the compression stroke.

In FIGS. 1*a*,1*b* and 4*a* there is shown a fuel injector or nozzle 32 received in a cavity 33 in the cylinder wall 21*a*. The injector/nozzle 32 has a pointed end 32' (see FIG. 4*a*) projecting through a bore 34 in the cylinder wall 21*a*. The bore 34 passes through the cylinder wall 21*a* at an oblique angle, which is not marked further in FIG. 4*a*, but which corresponds to the angle u, as shown in FIG. 2. The pointed end 32' projects further through a bore 35 in the bushing 23, in alignment with the bore 34. Mouth 36 (see FIG. 4*a*) of the nozzle/injector 32 is arranged so that a jet 37 of fuel can be directed, as is shown in FIG. 4*a*, obliquely inwards in a rotating mass of air as shown by the arrows 38 in cylinder 21, just in front of a spark plug 39 (possibly ignition pin) arranged in a chamber zone which forms a part of the combustion chamber K1 (see FIG. 1*b*).

In FIG. 4*b* there is shown an alternative construction of the solution as shown in FIG. 4*a*, there being employed in addition to a first fuel nozzle 32 and a first ignition arrangement 39 a second fuel nozzle 32*a* and a second ignition arrangement 39*a* in one and the same disc-formed combustion chamber K1. Both the nozzles 32 and 32*a* are designed correspondingly as described with reference to FIG. 4*a* and both the ignition arrangements 39 and 39*a* are corresponding as described with reference to FIG. 4*a*. In the nozzle 32*a* the associated components are designated with the reference designation "a" in addition.

In the illustrated embodiment of FIG. 4*b* the nozzles 32,32*a* are shown mutually displaced an angular arc of 180°, while the ignition arrangements 39,39*a* are correspondingly shown mutually displaced an angular arc of 180°. In practice the relative spacings can be altered as required, that is to say with different mutual spacings, for instance depending upon the point in time of the mutual ignition, and the like.

Further there is indicated in FIG. 1 a cooling water system for general cooling of the cylinder 21. The cooling water system comprises a cooling water intake not shown further having a first annular cooling water duct 41 and a second annular cooling water duct 42. The ducts 41,42 are mutually connected via an annular series of axially extending connecting ducts 43 (see FIG. 3). The axially extending ducts 43 pass through the cylinder wall 21*a* in each intermediate zone 27*a* between the exhaust ports 27, so that these zones 27*a* especially can be prevented from superheating by being subjected locally to a flowing through of cooling medium. The discharge of cooling water, which is not shown further in FIG. 1, is connected to the cooling water duct 42 remote from the cooling water intake, in a manner not shown further.

Internally in the bushing 23 there are two axially movable pistons 44,45 movable towards and away from each other. Just by the respective top 44*a*,45*a* of the piston and by the skirt edge 44*b*,45*b* of the piston there is arranged a set of piston fourths 46 in a manner known per se. The pistons 44,45 are movable synchronously towards and away from each other in a two cycle engine system.

Further details of the pistons are shown in FIG. 5*h*. The piston 44 is shown in the form of a relatively thin-walled cap having top portion 44*a* and skirt portion 44*b*. Innermost in the internal hollow space of the piston there is arranged a support disc 44*c*, thereafter follows a head member 48*c* for an associated piston rod 48, a support ring 44*d* and a clamping ring 44*e*.

The head member 48*c* is provided with a convexly rounded top surface 48*c*' and concavely rounded off bottom surface 48*c*", while the support disc 44*c* is designed with an equivalent concavely rounded upper support surface 44*c*' and the support ring 44*d* is provided with a convexly rounded lower support surface 44*d*'. The head member 48*c* is consequently adapted to be tilted about a theoretical axis relative to the piston controlled by the support surfaces 44*c*' and 44*d*'. By abutment against a shoulder portion 44*f* internally in the piston the ring 44*e* provides for the head member 48*c*—and thereby the piston rod 48—having a certain degree of fit and thereby a certain possibility of turning about said theoretical axis of the piston 44 during operation.

The head member 48*c* is provided with a middle, sleeve-shaped carrying portion 48*g* having rib portions 48*g*' projecting laterally outwards which form a locking engagement with equivalent cavities (not shown further) internally in the associated piston rod 48 (see FIGS. 1*a* and 1*b*).

In FIG. 1*a* the pistons 44,45 are shown in their equivalent, one outer position. This outer position, where there is a maximum spacing between the pistons 44,45, is designated herein generally as a dead point 0*a* for the piston 44 and 0*b* for the piston 45.

In the said dead point positions 0*a* and 0*b* the piston 44 uncovers the scavenging ports 24, while the piston 45 uncovers the exhaust ports 25, opening and closing of the scavenging ports 24 being controlled by positions of the piston 45 in the associated cylinder 21, while opening and closing of the exhaust ports 25 is controlled by positions of the piston 44 in the associated cylinder 21. This control will be described in more detail in what follows having regard to FIGS. 12–14.

In addition this control will be described with additional effects having regard to the afore-mentioned regulation of the cam guide device 12*b* along the drive shaft 11.

When the pistons 44,45 occupy their opposite outer positions, where there is a minimal spacing between, as is shown in FIG. 1*b*, these positions are usually designated as dead point positions. However according to the present invention the pistons 44,45 are stationary, that is to say without or broadly speaking without axial movement relative to each other in and at these dead point positions. In that the pistons are held stationary not only in the dead point position, but also in adjacent portions of the respective "sine"-like plane, as will be described further below, a volumetrically more or less constant working chamber (combustion chamber) over a certain arcuate length can be ensured, that is to say over a considerably longer portion of the "sine"-like plane than known hitherto.

Consequently the pistons 44,45 are at rest or broadly speaking at rest over a portion of the "sine"-like plane, which is designated herein as a "dead portion" 4*a* for the piston 44 and as a "dead portion" 4*b* for the piston 45. Such dead portions 4*a* and 4*b* are further illustrated in FIGS. 12 and 13.

In said dead portions there is defined in the working chamber K a so-called "dead space", which herein (for reasons which will be evident from what follows) is designated as the combustion chamber K1. The combustion chamber K1 is according to the invention mainly defined in and at a transition portion between the compression phase and expansion phase of the two cycle engine, as will be described in more detail in what follows.

During the expansion phase, that is to say from the position of the piston as shown in FIG. 1*b* to the position of the piston as shown in FIG. 1*a*, the working chamber K is expanded from a minimum volume, shown by the combustion chamber K1, gradually to a maximum volume, as shown in FIG. 1*a* and at said dead point 0*a* and 0*b* in FIGS. 9 and 10, the combustion chamber K1 being gradually expanded with another chamber K2 in which the expansion and compression strokes of the pistons 44,45 take place.

According to the invention the combustion chamber K1 is defined to a considerable degree in said dead portion/dead space. In practice however the combustion can also continue a bit just outside said dead space, something which will be explained in more detail below.

In connection with the change of the compression ratio in the working chamber there can be a question in the position as shown in FIG. 10 about different volumes in the combustion chamber K1 all according to which regulation is effected during use of the engine. From the above there should in that case also be a question about different volumes in the combustion chamber in the opposite position as shown in FIG. 1*a*.

However one must be aware of the piston strokes for the individual piston 44,45 being precisely equally long under all operative conditions, regardless of the compression ratio which must be employed.

Each piston 44,45 is rigidly connected to its respective pipe-shaped piston rod 48 and 49, which is guided in a rectilinear movement via a so-called cross-head control 50. The cross-head control 50 is arranged partly in the engine block 17 and partly in the respective cover member 17*a* and 17*b* at the equivalent free outer end of the respective piston rod 48,49. The cross-head control 50, which is shown in detail in FIG. 5*a*, forms an axial guide for the piston rod 48 and 49 just within and just outside the engine block 17.

With reference to FIG. 5*a* there is a rotary pin 51 which is fastened at one end of the pipe-shaped piston rod 48 and which passes through the piston rod 48 crosswise, that is to say through its pipe hollow space 52. On a middle portion 51*a* of the rotary pin 51, that is to say internally in said hollow space 52, there is rotatably mounted a main castor 53, while on one end portion 51*b* of the rotary pin 51 on the outwardly facing side 48*a* of the piston rod 48 there is rotatably mounted an auxiliary castor 55.

The main castor 53 comprises an inner hub portion 53*a* having a roller bearing 53*b* and an outer rim portion 53*c*. The rim portion 53*c* is provided with a double curved, that is to say ball sector-shaped roller surface 53*c'*.

The auxiliary castor 55 has a construction corresponding to the main castor 53 and comprises an inner hub portion 55*a*, a middle roller bearing 55*b* and an outer rim portion 55*c* with ball sector-shaped roller surface 55*c'*.

The main castor 53 is adapted to be rolled off along a roller surface 54 concavely curved in cross-section, which forms a part of a so-called "sine"-like curve 54' as shown in FIGS. 6–8. By employing a ball sector-shaped roller surface 53*c'*, which rolls along an equivalently curved guide surface 54 of the cam guide device 12*a* and 12*b*, an effective support abutment can be ensured between the castor 53 and the guide surface 54 under varying working conditions, and possibly with a somewhat obliquely disposed castor and/or obliquely disposed piston rod 48 (49), such as this being able to be permitted in the pivotable mounting of the piston rod 48 in the piston 44, as shown in FIG. 5*h*.

The "sine"-like curve 54' is designed in the cam guide device 12*a* and 12*b* of the drive shaft on a side facing equivalently axially outwards from the intermediate cylinder's 21. The auxiliary castor 55 is adapted to be rolled off against and along an equivalent, other "sine"-like curve (not shown further) concavely curved in cross-section along a roller surface 56*a* in a roller path, which is designed in the cam guide device 12*a* (and 12*b*) radially just within the roller surface 54.

In the embodiment illustrated in FIG. 5*a* the "sine"-like curve 54*a'* is placed radially outermost, while the "sine"-like curve 56*a'* is placed in the cam guide device 12*a* a distance radially within the "sine"-like curve 54*a'*. Alternatively the "sine"-like curve 54*a'* can be arranged radially within the "sine"-like curve 56*a'* (in a manner not shown further).

In each of the cam guide devices 12*a* and 12*b* there are designed a corresponding pair of "sine"-like curves 54*a'*, 56*a'* in a manner not shown further and each "sine"-like curve can be provided with one or more "sine"-like planes as required.

In FIG. 1 schematic reference is made to a cam guide device 12*a* and 12*b*, while the details in the associated "sine"-like curves and "sine"-like planes are shown further in FIGS. 9–14.

The "sine"-like Concept.

Generally the "sine"-like concept can be applied with an odd numbered number (1,3,5 etc.) of cylinders, while an even numbered (2,4,6 etc.) number of "sine"-like planes is employed and vice-versa.

In a case where there is employed in each of the cam guide devices 12*a* and 12*b* a single "sine"-like plane (having a "sine"-like top and a "sine"-like bottom), that is to say the "sine"-like plane covers an angular arc of 360°, it is however immaterial whether an odd numbered or even numbered number of cylinders is employed. Correspondingly with a number of two (or more) "sine"-like planes there can for instance be employed a larger or smaller number of cylinders as required.

The said case with a single "sine"-like plane can be especially of interest for use in engines running rapidly which are driven at speeds over 2000 rpm.

According to the "sine"-like concept the individual engine can be "internally" geared with respect to speed, all according to which number of "sine"-like tops and "sine"-like bottoms is to be employed at each 360° revolution of the drive shaft. In other words according to the "sine"-like concept both engines can be built precisely in the revolutions per minute region which is relevant for the individual application.

Generally the series arranged cylinders of the engine, with associated pistons, of the illustrated embodiment are arranged in specific angular positions around the axis of the drive shaft, for instance with mutually equal intermediate spaces along the "sine"-like plane or along the series of "sine"-like planes (the "sine"-like curve).

For example for a two cycle or four cycle engine numbering three cylinders (see FIG. 6), there can be employed for each 360° revolution two "sine"-like tops and two "sine"-like bottoms and four oblique surfaces lying between, that is to say two "sine"-like planes are arranged after each other in each cam guide device 12*a*,12*b*. Consequently in a four cycle motor four cycles can be obtained for each of the two pistons of the three cylinders with each revolution of the drive shaft/cam guide devices and four cycles for each of the two pistons of the three cylinders in a two cycle engine.

Correspondingly for a two cycle engine numbering five cylinders, as is shown in FIGS. 9 and 10, there can be employed, for each 360° revolution, a "sine"-like curve with two "sine"-like tops and two "sine"-like bottoms and four oblique surfaces lying between, that is to say two "sine"-like planes arranged after each other in each cam guide device 12*a*,12*b*, so that in a two cycle engine four cycles are obtained for each of the two pistons of the five cylinders with each revolution.

The support rollers of the pistons are placed in the illustrated embodiment with equivalently equal angular intermediate spaces, that is to say in equivalent rotary angular positions along the "sine"-like curve, so that they are subjected one after the other to equivalent piston movements in equivalent positions along the respective "sine"-like planes.

The engine power is consequently transferred from the different pistons 44,45 one after the other via the support rollers 53 in the axial direction for the drive shaft 11 via respective "sine"-like curves each with their "sine"-like plane, and the drive shaft 11 is thereby subjected to a compulsory rotation about its axis. This occurs by piston rods of the engine being moved parallel to the longitudinal axis of the drive shaft and support rollers of the piston rods being forcibly rolled off along the "sine"-like planes. The engine power is thereby transferred in an axial direction from support rollers of the piston rods to the "sine"-like planes, which are forcibly rotated together with the drive shaft 11 about its axis. In other words the transfer of motive power is obtained from an oscillating piston movement to a rotational movement of the drive shaft, the motive power being transferred directly from respective support rollers of the piston rods to "sine"-like planes of the drive shaft.

In FIG. 6*a* there is schematically illustrated a support roller 53 on an obliquely extending portion of a "sine"-like curve 8*a*. Axial driving forces are shown from an associated piston 44 having piston rod 48 in the form of an arrow Fa and equivalently in a radial plane decomposed rotational forces transferred to the "sine"-like plane 8*a* shown by an arrow Fr.

The rotational forces can be deduced from formula 2:

$$Fr=Fa.\tan f.$$

According to the invention one achieves inter alia, by means of a particular design of the "sine"-like plane according to the invention, the expansion stroke of the pistons 44,45—reckoned angularly relative to the rotational arc of the drive shaft—becoming larger than the compression stroke of the pistons 44,45. In spite of the different speeds of movement of the pistons in opposite directions of movement, a relatively more uniform transfer of motive force to the drive shaft 11 can hereby be ensured and in addition a "more uniform", that is to say more vibration-free running of the engine.

In FIGS. 6–8 there is schematically shown the mode of operation pf a three cylinder engine 10, in which only the one piston 44 is shown of the two co-operating pistons 44,45, illustrated in a planar spread condition along an associated "sine"-like curve 54', which consists of two mutually succeeding "sine"-like planes, plus the associated main castor 53 of the associated one piston rod 48. In each of the FIGS. 6–8 there is schematically shown the associated one piston 44 in each of three cylinders 21 of the engine, an equivalent arrangement being employed for the piston 45 at the opposite end of the cylinders. For the sake of clarity the cylinder 21 and the opposite piston 45 have been omitted from FIGS. 6–8, only the piston 44, its piston rod 48 and its main castor 53 being shown. Axial movements of the piston 44 are illustrated by an arrow 57, which marks the compression stroke of the piston 44, and an arrow 58, which marks the expansion stroke of the piston 44.

The "sine"-like curve 54' is shown with a lower roll path 54, which has a double "sine"-like plane-shaped contour and which generally guides the movement of the main castor 53 in an axial direction, in that it more or less constantly effects a downwardly directed force from the piston 44 via the main castor 53 towards the roll path 54 in the expansion stroke and an upwardly directed force from the roll path 54 via the main castor 53 towards the piston 44 in the compression stroke. The auxiliary castor 55 (not shown further in FIGS. 6–8) is received with a sure fit relative to an upper roll path 54*b*, as is shown in FIG. 5*a*. For illustrative reasons the said roll path 56*b* is shown vertically above the main castor 53 in FIGS. 6–8, so as to indicate the maximum movement of the main castor in an axial direction relative to the roll path 54. In practice it will be the auxiliary castor 55 which controls the possibility for movement of the main castor 53 axially relative to its roll path 54, as is shown in FIG. 5*a*.

The auxiliary castor 55 is normally not active, but will control movement of the piston 44 in an axial direction in the instances the main castor 53 has a tendency to raise itself from the cam-forming roll path 54. During operation lifting of the main castor 53 in an unintentional manner relative to the roll path 54 can hereby be avoided. The roll path for the auxiliary castor 55 is, as shown in FIG. 5, normally arranged in the fixed fit spacing from the roll path of the main sector 53.

In FIGS. 6–8 the "sine"-like curve 54' is shown with a first relatively steep and relatively rectilinear running curve portion 60 and a subsequent, more or less arcuate, top-forming transition portion/dead portion 61 and a second relatively more gently extending, relatively rectilinearly running curve portion 62 and a subsequent arcuate transition portion/dead portion 63. These curve contours are however not representative in detail of the curve contours which are employed according to the invention, examples of the correct curve contours being shown in more detail in FIGS. 12 and 13.

The "sine"-like curve 54' and the "sine"-like plane 54 are shown in FIGS. 6–8 with two tops 61 and two bottoms 63 and two pairs of curve portions 60,62. In FIGS. 6–8 there are illustrated three pistons 44 and their respective main castor 53 shown in equivalent positions along an associated "sine"-like curve in mutually different, succeeding positions. It is evident from the drawing that the relatively short first curve portions 60 entail that at all times only one main castor 53 will be found on the one short curve portion and two or roughly two main castors 53 on the two longer curve portions 62. In other words with the illustrated curve contour different forms of curve portions can be employed for the compression stroke relative to the form of the curve portions for the expansion stroke. Inter alia one can hereby ensure that the two main castors 53 at all times overlap the expansion stroke, while the third main castor 53 forms a part of the compression stroke. In practice movement of the piston 44 is achieved with relatively greater speeds of movement in the axial direction in the compression stroke than in the expansion stroke. In themselves these different speeds of movement do not have a negative influence on the rotational movement of the drive shaft 11. On the contrary it means one is able to observe that more uniform and less vibration-inducing movements in the engine can be obtained, with such an unsymmetrical design of the curve portions 60,62 relative to each other.

Further there is obtained an increase of the time which is relatively placed for disposition in the expansion stroke relative to the time which is reserved for the compression stroke.

In a practical construction according to FIGS. 6–8 there is chosen in a 180° working sequence an arc length for the expansion stroke of about 105° and an equivalent arc length for the compression stroke of about 75°. But actual arc lengths can for instance lie between 110° and 95° when the expansion stroke is concerned and equivalently between 700° and 85° when the compression stroke is concerned.

On using for instance a set of three cylinders 21 associated with three pairs of pistons 44,45, as is described above, two tops 61 and two bottoms 63 are employed for each 360° revolution of the drive shaft 11, that is to say two expansion strokes per piston pair 44,45 per revolution.

On using for instance four pairs of pistons there can be correspondingly employed three tops and three bottoms, that is to say three expansion strokes per piston pair per revolution.

In the embodiment according to FIGS. 9–10 there is discussed a five cylinder engine with five pairs of pistons, associated with two tops and two bottoms, that is to say with two expansion strokes per piston pair per revolution.

Typical Cam Guide Arrangement According to the Invention.

In what follows there will be described with reference to FIGS. 9 and 10 in more detail a preferred embodiment of the "sine"-like concept according to the invention in connection with a five cylinder, two cycle-combustion engine with two associated, mutually differing cam guide curves 8*a* and 8*b*, as shown in FIGS. 9 and 10 and in FIGS. 12 and 13.

In FIG. 14 there is schematically shown a midmost, theoretical cam guide curve 8*c*, which shows the volume change of the working chamber K from a minimum, as shown in the combustion chamber K1 in the dead zones 4*a* and 4*b*, to a maximum, as shown in the maximum working chamber K in the dead points 0*a* and 0*b* (see FIGS. 9–10 and 12–14).

According to the invention the curve 8*b*, as is illustrated in FIGS. 12–14, is shown at the dead point 0*b* phase-displaced an angle of rotation of 14° in front of the dead point 0*a* of the curve 8*a*.

The direction of rotation of the curves 8*a* and 8*b*, that is to say the direction of rotation of the drive shaft 11, is illustrated by the arrow E.

In FIGS. 9 and 10 there are schematically illustrated five cylinders 21-1, 21-2, 21-3, 21-4 and 21-5 and belonging to two associated curves 8*a* and two curves 8*b*, shown spread in a schematically illustrating manner in one and the same plane. The five cylinders 21-1, 21-2, 21-3, 21-4 and 21-5 are shown in respective angular positions with a mutual angular space of 72°, that is to say in positions which are uniformly distributed around the axis of the rotary shaft 11.

In FIG. 12 there is shown a first curve 8*a*, which covers an arc length of 180° from a position 0°/360° to a position 180°. A corresponding curve 8*a* (see FIG. 9) passes over a corresponding arc length of 180° from position 180° to position 360°. In other words two succeeding curves 8*a* for each 360° revolution of the drive shaft.

The curve 8*a* shows in position 0°/360° a first dead point 0*a*. From position 0° to a position 38.4° there is shown a first transition portion 1*a*, which corresponds to a first part of a compression stroke and from position 38.4° to position 59.2° an obliquely (upwardly) extending rectilinear portion 2*a*, which corresponds to a main part of the compression stroke and from position 59.2° to a position 75° a second transition portion 3*a*, which corresponds to a finishing part of the compression stroke.

Thereafter from the position 75° to a position 85° there is shown in connection with a second dead point a rectilinear dead portion 4*a*, which is shown passing over an arc length of 10°.

From the position 80° to a position 95.8° there is shown a transition portion 5*a*, from the position 95.8° to a position 160° an oblique downwardly extending, rectilinear portion 6*a* and from the position 160° to a position 180° a transition portion 7*a*. The three portions 5*a*,6*a*,7*a* together constitute an expansion portion.

In position 180° is show anew the dead point 0*a* and thereafter the cam guide curve continues via a second corresponding curve 8*a*, from the position 180° to the position 360°, that is to say with two curves 8*a* which together extend over an arc length of 360°.

In FIG. 13 there is shown an equivalent (mirror image) curve contour for the remaining curve 8*b*, shown with a dead point 0*b* and succeeding curve portion 1*b*–7*b*.

There is shown the dead point 0*b* in a position 346°, the curve portion 1*b* between the positions 346° and 3°, the curve portion 2*b* between the positions 3° and 60°, the curve portion 3*b* between the positions 60° and 75°, the curve portion 4*b* between the positions 75° and 80°, the curve portion 5*b* between the positions 80° and 101.5°, the curve portion 6*b* between the positions 101.5° and 146° and the curve portion 7*b* between the positions 146° and 166°, that is to say with the dead point 0*b* shown anew in the position 166°.

The cam guide continues with a corresponding curve 8*b* between the positions 166° and 346° (see FIG. 10).

The first curve 8*a* (FIG. 12) controls opening (position 160°/340°) and closing (position 205°/25°) of exhaust ports 25.

The second curve 8*b* (FIG. 13) control opening (position 146°/326°) and closing (position 185°/5°) of scavenging ports 24.

In FIG. 14 there is shown a phase-displacement of 14° between the dead points 0*a* and 0*b*, in the illustrated, schematic comparison of the curves 8*a* and 8*b*. Curve 8*b*, as shown by broken lines in FIG. 14, is for comparative reasons shown in mirror image form relative to the curve 8*a*, which for its part is shown in full lines in FIG. 14. By chain lines there is shown the midmost, theoretical curve 8*c*, which illustrates a curve contour approximately like or more like a mathematical "sine"-like curve-contour.

In FIGS. 9 and 10 there is shown the "sine"-like plane 8*b* in a position 14° in front of the position for the "sine"-like plane 8*a*. The five said cylinders 21-1, 21-2, 21-3, 21-4 and 21-5 are shown in successive positions relative to the associated "sine"-like plane and individually in successive working positions, as shown in the following diagram 1 and diagram 2.

Diagram 1 with reference to FIG. 9 and FIG. 12–13.

| Cyclinder No. | Angle Position | Working Position | Exhaust Ports | Scavenging Ports | Curve Zone 8a/8b |
|---|---|---|---|---|---|
| 21-1 | 3°/183° | compression | closed | open* | 1a/1b |
| 21-2 | 75°/255° | compression | closed | closed | 4a/4b |
| 21-3 | 47°/337° | expansion | closed | closed | 6a/7b |
| 21-4 | 219°/39° | compression | closed | closed | 2a/2b |
| 21-5 | 291°/101° | expansion | closed | closed | 5b/6a |

*The scavenging ports 24 open in position 160°/340° and close in position 25°/205°, that is to say the scavenging ports 24 are held open over an arc length of 45°.

The exhaust ports 25 are held on the other hand open over an arc length of 39°, that is to say over an arc length which is phase-displaced 14° relative to the arc length in which the scavenging ports are open (see FIG. 14).

The scavenging ports 24 can consequently be open over an arc length of 20° (see the curve portions 1*a*–3*a* in FIG. 12 and the single hatched section A' in FIG. 14) after the exhaust ports 25 are closed. This means that the compression chamber over the last-mentioned arc length of 20° can inter alia be supplied an excess of scavenging air, that is to say is overloaded with compressed air.

Diagram 2 with reference to FIG. 10 and FIG. 12–13.

| Cyclinder No. | Angle Position | Working Position | Exhaust Ports | Scavenging Ports | Curve Zone 8a/8b |
|---|---|---|---|---|---|
| 21-1 | 21°/201° | compression | closed | closed | 1a/2b |
| 21-2 | 93°/273° | expansion | closed | closed | 5e/5b |
| 21-3 | 165°/345° | expansion | open** | open* | 7a/7b |
| 21-4 | 237°/57° | compression | closed | closed | 2a/2b |
| 21-5 | 309°/129° | expansion | closed | closed | 6a/6b |

**The exhaust ports open in position 146°/326° and close in position 185°/5°, that is to say the exhaust ports 25 are open over an arc length of 39°.

From FIG. 14 it will be evident from the marked off, individual hatched sections B' that the exhaust ports 25 can be held open over an arc length of 14° before the scavenging ports 24 open.

The said sections A' and B' show the axial dimensions of the exhaust ports 25 and the axial dimensions of the scavenging ports 24 in a respective outer portion of the working chamber K. The ports 24 and 25 can thereby be designed of equal height in each end of the working chamber K. The said height is shown in FIGS. 12–14 by 12.

In an angle zone of 5° (from position 75° to position 80°—see especially FIG. 13) of the "sine"-like plane 8*b* and in an angle zone of 10° (from position 75° to position 85°—see especially FIG. 12) of curve 8*a*, the respective associated piston 44 and 45 is held pushed in to the maximum with a minimum spacing 1 of for instance 15 mm between the piston head 44*a* and the middle line of the working chamber.

With reference to FIG. 12 it must further be observed that over an arc length of 36.6°, from position 59.2° to position 95.8°, the spacing between the piston heads is changed relatively little. The spacing from the piston head 44*a* to the middle line 44' is changed from a minimum 1=15 mm (in the dead portion 75°–80°) to a 20 mm spacing (position 93° FIG. 13).

Correspondingly the spacing from the piston head to the middle line 44' is changed from a minimum 1=15 mm in the dead portion 75°–80° to a 25 mm spacing in position 57° FIG. 13.

Over said arc length of 36.6° the volume in the combustion chamber K1 is kept approximately constant between the pistons 44,45.

Combined Effects of two Phase-displaced "sine"-like Planes.

From FIG. 14 the contours of the respective two curves 8*a*,8*b*, which are shown schematically in mirror image relative to each other will be evident. Curve 8*a* is shown real with a full line, while curve 8*b* is shown with a broken line, in mirror image about a middle axis between the pistons 44,45. The curve 8*c* shows a theoretical midmost curve between the curves 8*a*,8*b*. It will be evident that the midmost curve 8*c* has a contour which lies more closely up to a sine curve contour than the contours of the curves 8*a*,8*b* individually. Consequently, even if one gets a relatively unsymmetrical contour in the curves 8*a*,8*b* mutually, a relatively symmetrical contour of the midmost curve 8*c* can be achieved.

Fuel is Injected:

At the close of the compression phase in curve zone 3*a* and 3*b* the fuel is injected in a jet with a flow into the rotating scavenging air current and is mixed/atomized effectively in the rotating scavenging air current.

Ignition Starter:

Immediately after the injection of fuel that is to say at the close of the compression phase electronically controlled ignition is initiated in curve zone 3*a* and 3*b*. Provision being made for effective rotation of the gas mixture of scavenging air and fuel in a fuel cloud past the ignition arrangement. According to the present invention one can aim with advantage at an ignition delay of 7–10% relative to the conventional ignition angle.

Combustion Phase

In the illustrated embodiment the combustion starts immediately after ignition and is accomplished mainly over a limited region in which the pistons roughly occupy a maximum pushed in position, that is to say at the close of the curve zone 3*a*,3*b*, that is to say in a region where the pistons are subjected to minimal axial movement. The combustion proceeds mainly or to a significant extent where the pistons 44,45 are held at rest in the inner dead portion 4*a* and 4*b*, that is to say over an arc length of 10° and 5° respectively. However the combustion continues as required to a greater or smaller degree in the following transition portion 5*a*,5*b* and in the main expansion portion 6*a*,6*b*, depending upon the speed of rotation of the rotary shaft. As a consequence of the rotating fuel cloud in the combustion chamber K1 in the dead portion 4*a*,4*b* and in that one can keep the flame front relatively short in the disc-shaped combustion chamber K1, there can be ensured in all instances fuel ignition for a main bulk of the fuel cloud in the combustion chamber K1, that is to say within said dead portion 4*a*,4*b*. In practice the combustion chamber can be allowed to be expanded to the portion 5*a*,5*b* just outside the dead portion 4*a*,4*b* with largely corresponding advantages in a defined volume of the working chamber K.

Speed of Combustion.

The speed of combustion is as known of an order of magnitude of 20–25 meters per second. By the application of a double set of fuel nozzles and a corresponding double set of ignition arrangements distributed over each quarter of the peripheral angle of the working chamber (see FIG. 4*b*) the combustion area can be effectively covered over the whole of the disc-shaped combustion chamber K1. In practice especially favorable combustion can thereby be achieved with relatively short flame lengths.

Optimal Combustion Temperature:

As a result of the concentrated ignition/combustion zone 3*a*,3*b* which is defined in the chamber K just in front of the combustion chamber K1 and the region 5*a*,5*b* immediately after the combustion chamber K1, that is to say in a coherent region 3*a*–5*a* and 3*b*–5*b*, where the pistons 44,45 are at rest or largely at rest, it is possible to increase the combustion temperature from usually about 1800° C. to 3000° C. It is possible thereby to achieve an optimal (almost 100%) combustion of the fuel cloud even before the pistons 44,45 have commenced fully the expansion stroke, that is to say at the end of the curve portions 5*a*,5*b*.

Ceramic Ring.

Provision is made for a ceramic ring, that is to say a ceramic coating applied in an annular zone of the working chamber K corresponding to a combustion region (3*a*–5*a*, 3*b*,5*b*), so that high temperatures can be employed especially in the combustion chamber K1, but also in the following portion 5*a*,5*b* of the combustion region. The ceramic ring which is shown with a dimension as indicated by a broken line 70 in FIGS. 12–14, comprises the whole combustion chamber K1 and is in addition extended further outwards in the combustion chamber over a distance 13.

Introductory Expansion Stroke.

After at least considerable portions of the fuel are consumed in the afore-mentioned combustion region (3*a*–5*a*, 3*b*,5*b*) and one has just started the expansion stroke there are generally optimal motive forces. More specifically this means that by way of the cam guide along the curves 8*a* and 8*b* there is obtained an optimal driving moment immediately the expansion stroke commences in the transition region 5*a*,5*b* and increases towards a maximum in the transition region 5*a*,5*b*. The driving moment is maintained largely constant in the continuation of the expansion stroke (in the region 6*a*,6*b*) and at least in the beginning of this region, as a consequence of possible after burn of fuel in this region in spite of the volumetric expansion which occurs gradually in the chamber K as the expansion stroke proceeds forward through this.

Expansion Phase.

According to the illustrated embodiment the compression phase takes place relative to the curves 8*a*,8*b* under angles of inclination of between about 25° and about 36° in the respective two curves 8*a* and 8*b*, that is to say with a mean angle (see FIG. 14) of about 30°. If desired the angles of inclination (and the mean angle) can for instance be increased to about 45° or more as required. The expansion phase takes place correspondingly in the illustrated embodiment at between about 22° and 27° in the two curves 8*a* and 8*b*, that is to say while at a mean angle (see FIG. 14) of about 24°.

As a result of the relatively steep (mean) curve contour of 30° in the compression phase and the relatively gentler contour 24° in the expansion phase, there is achieved a particularly favorable increase of the durability in time of the expansion stroke relative to the durability of the compression stroke.

According to the invention one can by means of said unsymmetrical relationship between the speed of movement in the compression stroke and the speed of movement in the expansion stroke, displace the start of the combustion process in the compression phase closer up to the inner dead point and thereby time-displace a larger part of the combustion process to the beginning of the expansion phase, without this having negative consequences for the combustion. Consequently there can be achieved a better control and a more effective utilisation of the motive force of the fuel combustion in the expansion phase than hitherto. Inter alia there can be displaced an otherwise possibly occurring, uncontrolled combustion from the compression phase over the dead point to the expansion phase and thereby convert such "pressure points", which involve uncontrolled combustion in the compression phase, to useful work in the expansion phase.

By extending the expansion phase at the expense of the compression phase a relatively higher piston movement is obtained in the compression phase than in the expansion phase. This has an influence on each set of pistons of the combustion engine in every single working cycle.

Rotation Effect in the Working Chamber.

There is established rotation of the gases in the working chamber by ejecting exhaust gases via obliquely disposed exhaust ports 25 (see FIG. 2) followed by the injection of scavenging air via the obliquely disposed scavenging air ports 24 (see FIG. 3). There is set up thereby a rotating, that is to say helical gas flow path (see arrow 38 in cylinder 21-1 in FIG. 9) which is maintained over the whole working cycle. The rotational effect is reactivated in the course of the working cycle, that is to say during the injection, ignition and combustion phases.

There is consequently supplied a new rotational effect to the gas flow 38 during transit in the working cycle by fuel injection via the nozzle 36 and subsequent fuel ignition via the ignition arrangement 39, the attendant combustion producing a direction fixed flame front with an associated pressure wave front roughly coinciding with the gas flow 38 already established. The rotational effect is consequently maintained during the whole compression stroke and is reactivated during transit by injecting fuel via an obliquely disposed nozzle jet 37, as shown in FIG. 4*a*, via a corresponding obliquely disposed nozzle mouth 36. Additional rotational effects are obtained in the combustion phase.

A still additional increase of the rotational effect can be obtained according to the construction as shown in FIG. 4*b* by the application of an extra (second) fuel nozzle 37*a*, which is disposed angularly displaced relative to the first fuel nozzle 37, and by the application of an extra ignition arrangement 39*a*, which is disposed angularly displaced relative to the first ignition arrangement 39. When the exhaust ports 25 open again, on the termination of the working cycle, the exhaust gas is exhausted with a high speed of movement, that is to say with a high rotational speed, during exhaustion of exhaust gas via the said obliquely disposed exhaust ports. Further the rotational effect for the exhaust gases is maintained immediately the obliquely disposed scavenging ports 24 open, so that the residues of the exhaust gases are scavenged with a rotational effect outwardly from he working chamber K at the close of the expansion phase and the beginning of the compression phase. Thereafter the rotational effect is maintained, after closing of the exhaust ports, the scavenging ports being continued to be held open over a significant arc length.

Regulation of the Compression Ratio of the Engine During Operation.

According to the invention it is possible to regulate the volume between pistons 44,45 of the cylinder 21 by regulating the mutual spacing between the pistons 44,45. It is hereby possible to directly regulate the compression ratio in the cylinder 21 as required, for instance during operation of the engine by means of a simple regulation technique adapted according to the "sine"-like concept.

It is especially interesting according to the invention to change the compression ratio in connection with starting up the engine, that is to say on cold start, relative to a most favorable compression ratio possible during usual operation. But it can also be of interest to change the compression ratio during operation for various other reasons.

A constructional solution for such a regulation according to the invention is based on pressure oil-controlled regulating technique. Alternatively there can be employed for instance electron-controlled regulating technique, which is not shown further herein, for regulating the compression ratio.

Alternatively there can be employed a corresponding regulating possibility also for the piston 45 by replacing the cam guide device 12*a* with a cam guide device correspondingly as shown for the cam guide device 12*b*.

It is apparent according to the invention that it is possible to regulate the position of both pistons 44,45 in the associated cylinder via their respective cam guide arrangement with their respective separate possibility of regulation, in a mutually independent manner.

It is also apparent that the regulation of the position of the pistons in the cylinder can be effected synchronously for the two pistons 44,45 or individually as required.

In FIGS. 15 and 16 there is shown schematically an alternative solution of certain details in a cam guide device, as it is referred to herein by the reference numeral 112*a*, and of an associated piston rod, as shown by the reference numeral 148 as well as a pair of pressure rollers, as shown by the reference numerals 153 and 155.

The Cam Guide Device 112*a:*

In the construction according to FIG. 1 the cam guide device 12*a* is shown having a relatively space-demanding design with associated casters 53 and 55 arranged at the side of each other in the radial direction of the cam guide device 12*a*, that is to say with the one caster 53 arranged radially outside the remaining caster 55 and with the associated "sine"-like grooves 54,55*c* illustrated correspondingly radially separated on each of their radial projections.

In the alternative construction according to FIGS. 15 and 16 the cam guide device 112*a* is shown with associated pressure spheres 153, 155 arranged in succession in the axial direction of the cam guide device 112*a*, that is to say with a sphere on each respective side of an individual, common projection, illustrated in the form of an intermediate annular flange 112. The annular flange 112 is shown with an upper "sine"-like curve forming "sine"-like groove 154 for guiding an upper pressure sphere 153, which forms the main support sphere of the piston rod 148, and a lower "sine"-like curve forming "sine"-like groove 155*a* for guiding a lower pressure sphere 155, which forms the auxiliary support sphere of the piston rod 148. The grooves 154 and 155*a* have, as shown in FIG. 15, a laterally concavely rounded form corresponding to the spherical contour of the spheres 153, 155. The annular flange 112 is shown having a relatively low thickness, but the low thickness can be compensated for as to strength in that the annular flange 112 has in the peripheral direction a self-reinforcing "sine"-like curve contour, such as indicated by the obliquely extending section of the annular flange illustrated in FIG. 16. In FIG. 15 the annular flange 112 is shown segmentally in section, while in FIG. 16 there is shown in cross-section a peripherally locally defined segment of the annular flange 112, seen from the inner side of the annular flange 112.

There can be employed a largely corresponding design of the afore-mentioned details in both cam guide devices, that is to say also in the cam guide device not shown further corresponding to the lower cam guide device according to FIG. 1.

The Piston Rod 148:

According to FIG. 1 a pipe-shaped, relatively voluminous piston rod 48 is shown, while in the alternative embodiment according to FIGS. 15 and 16 there is illustrated a slimmer, compact, rod-shaped piston rod 148 having a C-shaped head portion 148*a* with two mutually opposite sphere holders 148*b*,148*c* for a respective pressure sphere 153,155.

The piston rod 148 can in a manner not shown further be provided with external screw threads which cooperate with internal screw threads in the head portion, so that the piston rod and thereby the associated sphere holder 148*b* can be adjusted into desired axial positions relative to the head portion 148*a*. This can inter alia facilitate the mounting of the sphere holder 148*b* and its associated sphere 153 relative to the annular flange 112.

In FIG. 16 the annular flange 112 is shown with a minimum thickness at obliquely extending portions of the annular flange, while the annular flange 112 can have in a manner not shown further a greater thickness at the peaks and valleys of the "sine"-like curve, so that a uniform or largely uniform distance can be ensured between the spheres 153,154 along the whole periphery of the annular flange.

By the reference numeral 100 there is referred to herein a lubricating oil intake, which internally in the C-shaped head portion 148*a* branches off into a first duct 101 to a lubricating oil outlet 102 in the upper sphere holder 148*b* and into a second duct 103 to a lubricating oil outlet 104 in the lower sphere holder 148*c*.

The Pressure Spheres 153,155:

Instead of the casters 53,55 shown according to FIG. 1, which are mounted in ball bearings, pressure spheres 153, 155 are shown according to FIGS. 15 and 16. The pressure spheres 153,155 are mainly adapted to be rolled relatively rectilinearly along the associated "sine"-like grooves 154, 155*a*, but can in addition be permitted to be rolled sideways to a certain degree in the respective groove as required. The spheres 153 and 155 are designed identically, so that the sphere holders 148*a*,148*b* and their associated sphere beds can also be designed mutually identically and so that the "sine"-like curves 154,155*a* can also be designed mutually identically.

The pressure spheres 153,155 are shown hollow and shell-shaped with a relatively low wall thickness. There are obtained hereby pressure spheres of low weight and small volume, and in addition there is achieved a certain elasticity in the sphere for locally relieving extreme pressure forces which arise in the sphere per se.

In FIGS. 17 and 18 a pair of guide rods 105,106 are shown which pass through internal guide grooves 107,108 along opposite sides of the head portion 148*a* of the piston rod 148.

What is claimed is:

1. Arrangement of a two cycle combustion engine (10, 100) having internal combustion, comprising a number of engine cylinders (21; 21-1–21-5), which are arranged in an annular series around a common middle drive shaft (11) and which have cylinder axes running parallel to the drive shaft, each cylinder including a pair of pistons (44,45) movable towards and away from each other and a common, intermediate working chamber (K) for each pair of pistons, while each piston (44,45) is provided with its axially movable piston rod (48,49), the free outer end of which forms via a support roller (53,55) a support against its curve-shaped, "sine"-like curve shaped, cam guide device (12*a*,12*b*), which is arranged at each of opposite ends of the cylinder (21; 21-1–21-5) and which controls movements of the piston relative to the associated cylinder, characterized in that the two pistons (44,45) in each cylinder (21; 21-1–21-5) have mutually differing piston phases, which are controlled by mutually differing cam guide devices (12*a*,12*b*), the cam guide devices (12*a*,12*b*) being designed with equivalent mutually differing "sine"-like planes (8*a*, 8*b*), the respective cam guide devices (12*a*, 12*b*) of the two pistons (44,45), in certain portions (1*a*–3*a*, 5*a*–7*a*; 1*b*–3*b*, 5*b*–7*b*) of the "sine"-like plane (8*a*,8*b*) are phase-displaced relative to each other and that remaining portions (4*a*,4*b*) of the "sine"-like planes are in mutual phase.

2. In combination a rotatable drive shaft;

an engine block having a plurality of cylinders disposed in parallel relation about a common central axis;

a pair of pistons disposed in facing relation to each other in at least one of said cylinders to define a working chamber therebetween, each said piston being reciprocally mounted in said one cylinder;

a pair of piston rods, each piston rod being connected to a respective one of said pistons for movement therewith and extending outwardly of said engine block;

a drive shaft disposed on said central axis and extending through said engine block; and a pair of cam guide devices connected to opposite ends of said drive shaft, each cam guide device having a curved cam surface in contact with a respective one of said piston rods for rotation of said cam guide device in response to an axial movement of said one piston rod and for rotating said drive shaft therewith, said curved cam surface of one of said cam guide devices having portions thereof in phase-displaced relation to portions of said curved cam surface of the other of said cam guide devices and portions thereof in mutually-phased relation to portions of said curved cam surface of said other of said cam guide devices.

3. The combination as set forth in claim 2 which further comprises a support roller on one end of a respective piston rod and in rolling contact with said cam surface of a respective cam guide device.

4. The combination as set forth in claim 2 wherein each said cam surface is a sine-like curved cam surface.

5. The combination as set forth in claim 2 said cam surface of at least one of said cam guide devices includes a rectilinear portion corresponding to a stationary "dead point" position of a respective one of said pistons in said cylinder between a compression stroke and an expansion stroke of said one piston in said cylinder.

6. The combination as set forth in claim 5 wherein stationary "dead point" position of said one piston defines, in part, a combustion chamber within said working chamber for combustion of a major fuel portion immediately before said expansion stroke.

7. The combination as set forth in claim 6 wherein each stationary "dead point" position occurs over an arc length of from 5° to 10° of the rotational arc of said drive shaft.

8. The combination as set forth in claim 2 wherein said one cylinder has a plurality of scavenging ports for delivering combustion air into said working chamber and a plurality of exhaust ports for expelling combusted gases from said working chamber, one of said pistons being disposed to open and close said scavenging ports and the other of said pistons being disposed to open and close said exhaust ports during reciprocation thereof.

9. The combination as set forth in claim 8 wherein said curved cam surface of one of said cam guide devices has a portion phase-displaced from said curved cam surface of the other of said cam guide devices to effect opening of said exhaust ports prior to opening of said scavenging ports.

10. The combination as set forth in claim 2 wherein said cam surface of each of said cam guide devices includes a rectilinear portion corresponding to a stationary "dead point" position of a respective one of said pistons in said cylinder between a compression stroke and an expansion stroke of said one piston in said cylinder.

11. The combination as set forth in claim 10 wherein said stationary "dead point" position of each said piston defines, in part, a combustion chamber within said working chamber of said respective piston for combustion of a major fuel portion immediately before said expansion stroke.

12. The combination as set forth in claim 10 wherein each said cylinder has a plurality of scavenging ports for delivering combustion air into a respective working chamber and a plurality of exhaust ports for expelling combusted gases from said respective working chamber, one of said pistons in each said cylinder being disposed to open and close said scavenging ports and the other of said pistons in each said cylinder being disposed to open and close said exhaust ports during reciprocation thereof.

13. The combination as set forth in claim 12 wherein said curved cam surface of one of said cam guide devices of a respective cylinder has a portion phase-displaced from said curved cam surface of the other of said cam guide devices of said respective cylinder to effect opening of said exhaust ports prior to opening of said scavenging ports.

* * * * *